US007696702B2

(12) United States Patent
Iwai

(10) Patent No.: US 7,696,702 B2
(45) Date of Patent: Apr. 13, 2010

(54) TRANSFORMER, BACKLIGHT APPARATUS, AND DISPLAY APPARATUS

(75) Inventor: Kenji Iwai, Kanagawa (JP)

(73) Assignee: Sony Corporation (JP)

( * ) Notice: Subject to any disclaimer, the term of this patent is extended or adjusted under 35 U.S.C. 154(b) by 300 days.

(21) Appl. No.: 11/999,126

(22) Filed: Dec. 4, 2007

(65) Prior Publication Data

US 2008/0143277 A1 Jun. 19, 2008

(30) Foreign Application Priority Data

Dec. 15, 2006 (JP) ..... P2006-338912

(51) Int. Cl.
*H05B 37/00* (2006.01)

(52) U.S. Cl. ..... 315/276; 315/279; 336/221; 336/222

(58) Field of Classification Search ..... 315/276, 315/277, 280, 278, 279, 282; 336/221, 222
See application file for complete search history.

(56) References Cited

U.S. PATENT DOCUMENTS 5,812,045 A * 9/1998 Ishikawa et al. ..... 336/83
6,624,596 B1 * 9/2003 Ohsawa et al. ..... 315/276

FOREIGN PATENT DOCUMENTS

| | | | |
|---|---|---|---|
| EP | 1 814 367 | A1 | 8/2007 |
| JP | 04-133411 | U | 12/1992 |
| JP | 10-223459 | A | 8/1998 |
| JP | 2004-111417 | A | 4/2004 |
| JP | 2006-140055 | A | 6/2006 |

* cited by examiner

*Primary Examiner*—David Hung Vu
(74) *Attorney, Agent, or Firm*—Lerner, David, Littenberg, Krumholz & Mentlik, LLP

(57) ABSTRACT

A transformer includes: a primary winding receiving portion having a primary winding wound around an axis; and a pair of secondary winding receiving portions each having a secondary winding wound around an axis and disposed on the opposite sides of the first primary winding receiving portion with a gap left in the axial direction. The gaps are formed in a size of a value higher than a first predetermined value, and the coupling coefficients between the first primary winding and the two secondary windings are set lower than a second predetermined value by the gaps.

11 Claims, 15 Drawing Sheets

FIG.11

LAMP CURRENT DISPERSION $\alpha$ (%)

| | | LAMP CURRENT IL (mm) | | | | | |
|---|---|---|---|---|---|---|---|
| | | 5 | 6 | 7 | 8 | 9 | 10 |
| DISTANCE G (mm) BETWEE PRIMARY-SECONDARY WINDUNGS | 1.5 | 30 | 20 | 12 | 8 | 6 | 5 |
| | 3 | 25 | 19 | 12 | 8 | 6 | 5 |
| | 5 | 20 | 15 | 10 | 7 | 5.5 | 5 |
| | 7 | 9 | 4.7 | 4.5 | 4 | 3.5 | 4.2 |
| | 10 | 10 | 5.4 | 5.1 | 4.4 | 4.2 | 4.3 |

TRANSFORMER, BACKLIGHT APPARATUS, AND DISPLAY APPARATUS

CROSS-REFERENCE TO RELATED APPLICATIONS

The present application claims priority from Japanese Patent Application No. JP 2006-338912, filed in the Japanese Patent Office on Dec. 15, 2006, the entire content of which is incorporated herein by reference.

BACKGROUND OF THE INVENTION

1. Field of the Invention

This invention relates to a transformer and a backlight apparatus as well as a display apparatus.

2. Description of the Related Art

A display apparatus is available wherein a liquid crystal panel of the transmission type is illuminated using a backlight apparatus in the past.

The backlight apparatus includes a cold cathode fluorescent lamp and a driving circuit (inverter circuit) which supplies a high frequency voltage higher than 1 kV to the cold cathode fluorescent lamp.

In most cases, the driving circuit includes a transformer (inverter transformer) for generating a high-voltage high-frequency voltage from a dc voltage.

In the past, the driving circuit in most cases has a configuration wherein one transformer is provided for one cold cathode fluorescent lamp. However, another configuration has become frequently adopted wherein a large number of cold cathode fluorescent lamps are driven by a single transformer in order to achieve power saving.

Incidentally, in order to keep the brightness of a plurality of cold cathode fluorescent lamps uniform, it is necessary to supply uniform current to the cold cathode fluorescent lamps. A driving circuit has been proposed which includes a balance transformer or a balance capacitor for suppressing the dispersion of current interposed between a transformer and each of a plurality of cold cathode fluorescent lamps in order to achieve such uniform current. A driving circuit of the type just described is disclosed, for example, in Japanese Patent Laid-Open No. 2006-140055.

SUMMARY OF THE INVENTION

However, according to the driving circuit of the type described above, a number of such balance transformers or balance capacitors, for example, equal to the number of cold cathode fluorescent lamps must be provided. Therefore, the driving circuit has a disadvantage that a high part cost is demanded. Besides, since the arrangement space for parts must be assured, the driving circuit is disadvantageous where it is intended to achieve reduction in cost and miniaturization.

Therefore, it is demanded to provide a transformer and a backlight apparatus as well as a display apparatus wherein a plurality of cathode fluorescent lamps can emit light with uniform brightness without using a balance transformer or a balance capacitor and reduction in cost and miniaturization can be achieved readily.

According to an embodiment of the present invention, there is provided a transformer including a primary winding receiving portion having a primary winding wound around an axis, and a pair of secondary winding receiving portions each having a secondary winding wound around an axis and disposed on the opposite sides of the first primary winding receiving portion with a gap left in the axial direction. The gaps are formed in a size of a value greater than a first predetermined value, the coupling coefficients between the first primary winding and the two secondary windings are set lower than a second predetermined value by the gaps.

According to another embodiment of the present invention, there is provided a backlight apparatus including a high frequency voltage generation section configured to generate a first high frequency voltage, a transformer configured to generate, from the first high frequency voltage supplied from the high frequency voltage generation section, a second high frequency voltage higher than the first high frequency voltage, and a plurality of cathode fluorescent lamps configured to receive the second high frequency voltage supplied to emit light. The transformer includes a primary winding receiving portion having a primary winding wound around an axis and a pair of secondary winding receiving portions each having a secondary winding wound around an axis and disposed on the opposite sides of the first primary winding receiving portion with a gap left in the axial direction. The gaps are formed in a size of a value greater than a first predetermined value, the coupling coefficients between the first primary winding and the two secondary windings are set lower than a second predetermined value by the gaps, the first high frequency voltage is supplied to the primary winding, and the secondary windings supply the second high frequency voltage to the cathode fluorescent lamps.

According to a further embodiment of the present invention, a display apparatus including a liquid crystal panel configured to display an image, and a backlight apparatus configured to illuminate the liquid crystal display panel. The backlight apparatus includes a high frequency voltage generation section configured to generate a first high frequency voltage, a transformer configured to generate, from the first high frequency voltage supplied from the high frequency voltage generation section, a second high frequency voltage higher than the first high frequency voltage, and a plurality of cathode fluorescent lamps configured to receive the second high frequency voltage supplied to emit light. The transformer includes a primary winding receiving portion having a primary winding wound around an axis, and a pair of secondary winding receiving portions each having a secondary winding wound around an axis and disposed on the opposite sides of the first primary winding receiving portion with a gap left in the axial direction. The gaps are formed in a size of a value greater than a first predetermined value, the coupling coefficients between the first primary winding and the two secondary windings are set lower than a second predetermined value by the gaps, the first high frequency voltage is supplied to the primary winding, and the secondary windings supply the second high frequency voltage to the cathode fluorescent lamps.

With the transformer, backlight apparatus and display apparatus, the gaps between the primary winding receiving portion and the secondary winding receiving portions are formed in a size of the value greater than the first predetermined value. Then, the coupling coefficients between the first primary winding and the two secondary windings are set lower than the second predetermined value by the gaps. By this, an influence of variation of current of a cathode fluorescent lamp connected to each two secondary winding which may be had on any other cathode fluorescent lamp can be suppressed.

Accordingly, the cathode fluorescent lamps can emit light with uniform brightness without using such a balance transformer or a balance capacitor as is used in existing transformers, and reduction in cost and miniaturization can be achieved readily.

BRIEF DESCRIPTION OF THE DRAWINGS

FIG. 11 is a table illustrating data of the measurement result of FIG. 10;

DETAILED DESCRIPTION OF THE PREFERRED EMBODIMENTS

First Embodiment

Figure 1:
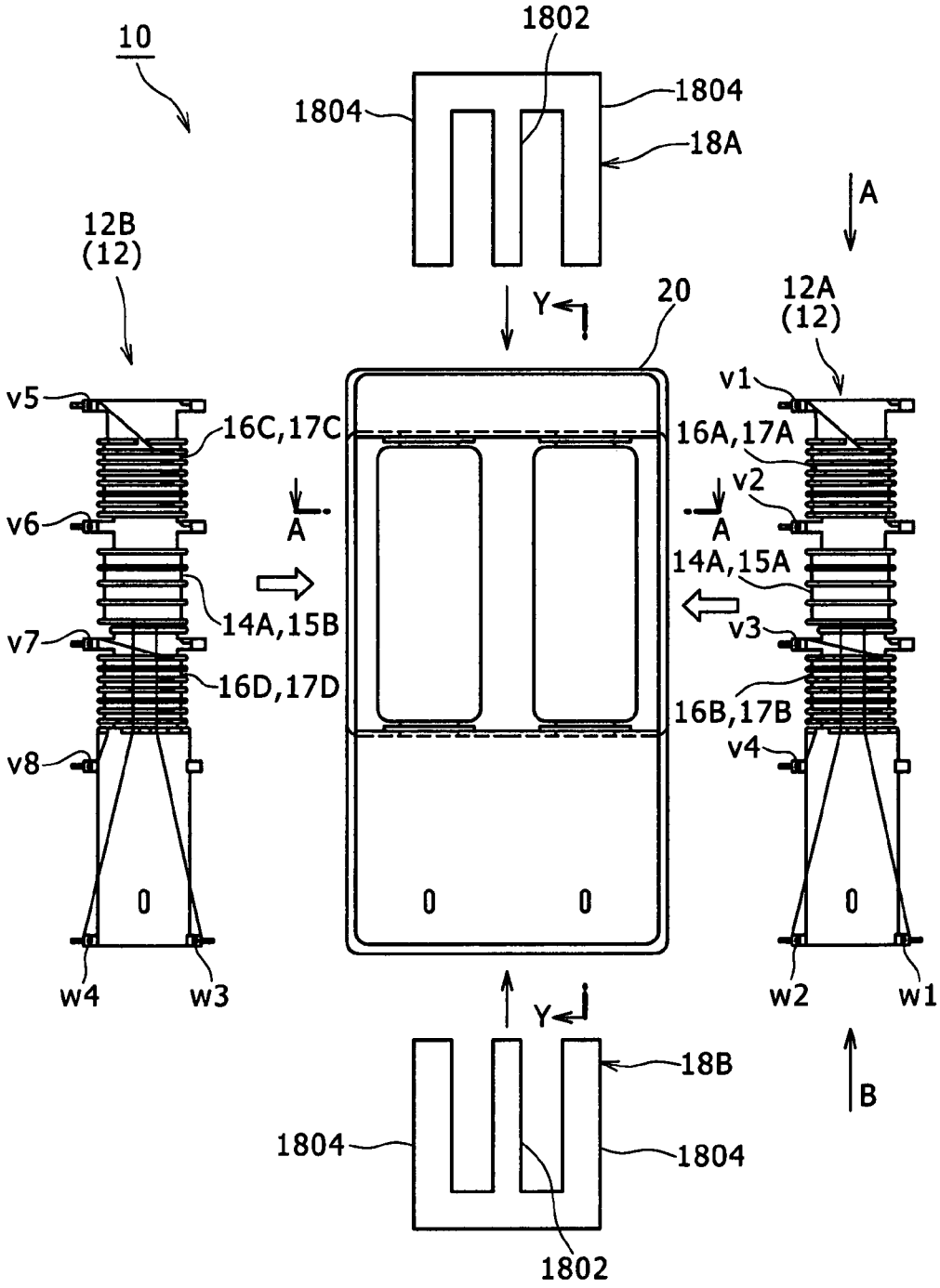
FIG. 1 is an exploded view showing a configuration of a transformer according to a first embodiment of the present invention.

Referring first to FIG. 1, there is shown a transformer according to a first embodiment of the present invention. The transformer 10 includes a case 20, and a bobbin 12 incorporated in the case 20.

In the present embodiment, the bobbin 12 is formed as first and second bobbins 12A and 12B.

The first and second bobbins 12A and 12B are formed from a synthetic resin material having an insulation characteristic. For example, PBT (polybutylene terephthalate) can be applied as the synthetic resin material.

The bobbins 12A and 12B individually include, on an axis thereof, a primary winding receiving portion 15 on which a primary winding 14 is wound and two secondary winding receiving portions 17 on which two secondary windings 16 are wound.

In particular, the first bobbin 12A includes a first primary winding receiving portion 15A on which a first primary winding 14A is wound and first and second secondary winding receiving portions 17A and 17B on which first and second secondary windings 16A and 16B are wound, respectively. The first and second secondary windings 16A and 16B are wound on both sides of the primary winding 14A on the same axis as that of the first primary winging wire 14A.

The second bobbin 12B includes a second primary winding receiving portion 15B on which a second primary winding 14B is wound and third and fourth secondary winding receiving portions 17C and 17D on which third and fourth secondary windings 16C and 16D are wound, respectively. The third and fourth secondary windings 16C and 16D are wound on both sides of the primary winding 14B on the same axis as that of the second primary winding 14B.

The two bobbins 12A and 12B on which the windings are wound are accommodated in the case 20, and two cores 18A and 18B are inserted into the bobbins 12A and 12B along an axial direction of the windings from the outside of the case 20. In particular, the two cores 18A and 18B are inserted into the first and second primary winding receiving portions 15A and 15B and first to fourth secondary winding receiving portions 17A, 17B, 17C and 17D from the axial direction of them.

Then, the transformer 10 is configured by sealing two bobbins 12A and 12B with a sealing material in the case 20.

Figure 2:
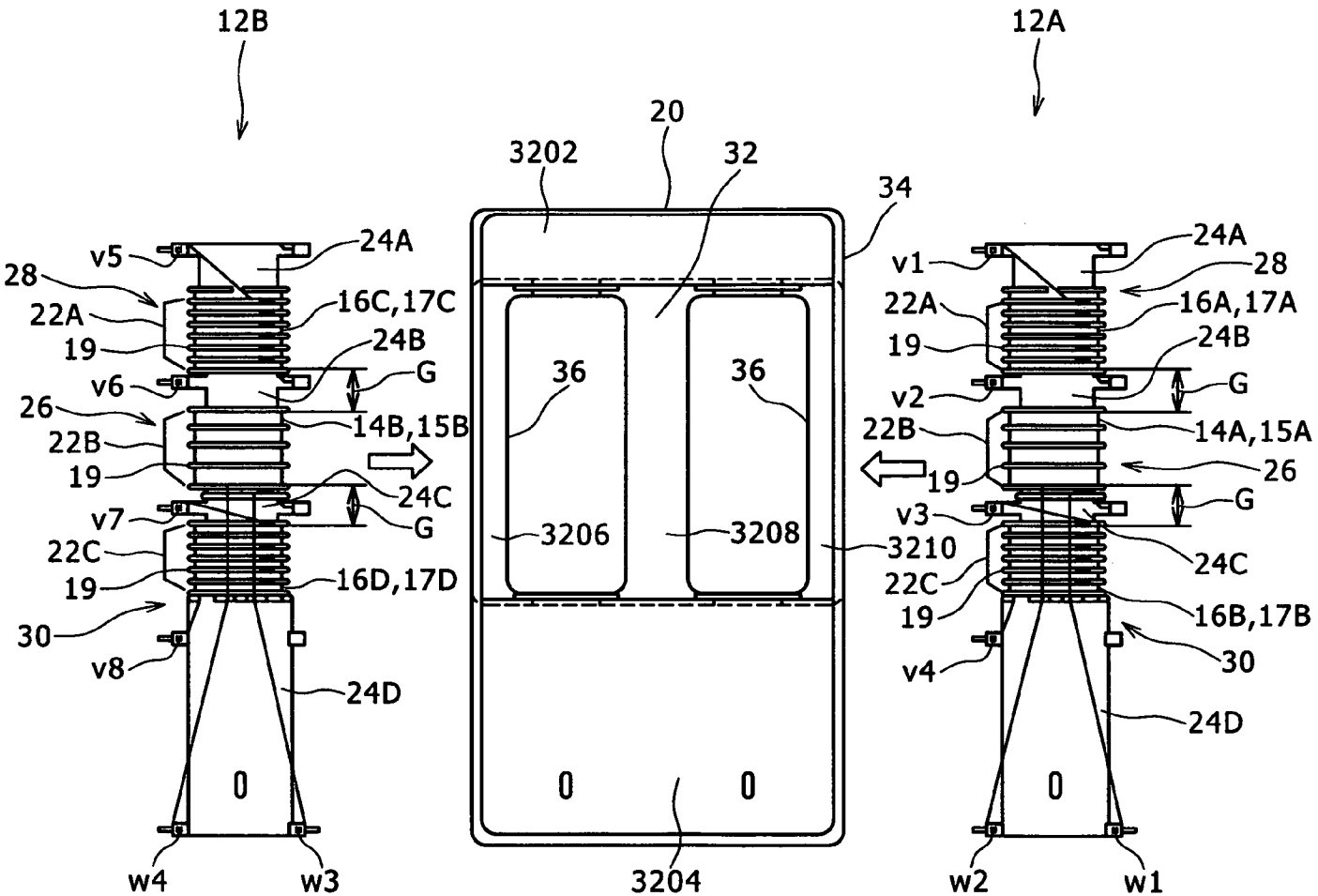
FIG. 2 is an exploded view showing a configuration of part of the transformer.

More particularly, referring to FIG. 2, the first and second bobbins 12A and 12B have the same shape and include three cylindrical portions including first to third cylindrical portions 22A, 22B and 22C individually having a rectangular framework-shaped cross section and four plate portions including first to fourth plate portions 24A, 24B, 24C and 24D each in the form of a plate.

The first plate portion 24A is connected to the first cylindrical portion 22A.

The second plate portion 24B connects the first cylindrical portion 22A and the second cylindrical portion 22B to each other.

The third plate portion 24C connects the second cylindrical portion 22B and the third cylindrical portion 22C to each other.

The fourth plate portion 24D is connected to the third cylindrical portion 22C.

The first to third cylindrical portions 22A, 22B and 22C are connected to each other so as to extend along the same axis by the first to fourth plate portions 24A, 24B, 24C and 24D.

Figure 3A:
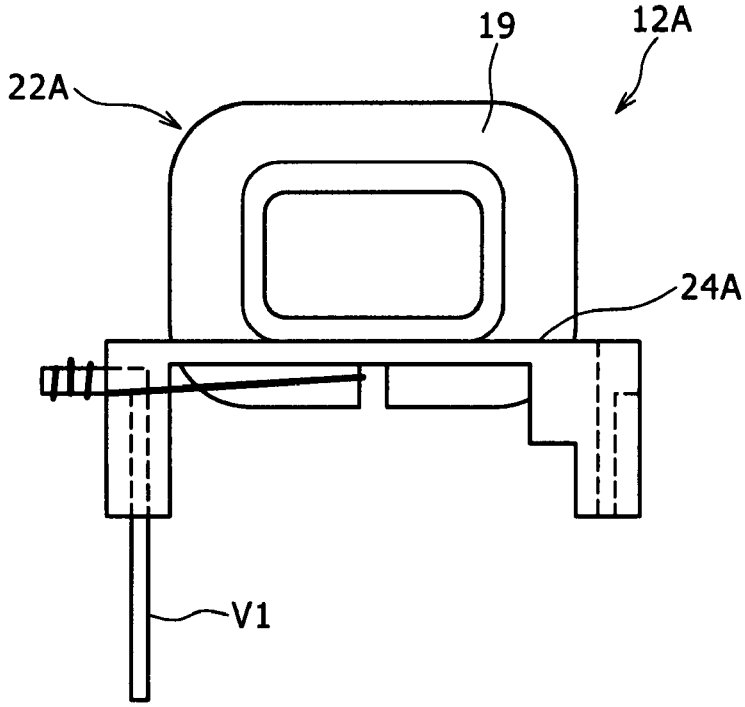
FIG. 3A is a view showing the transformer as viewed in the direction indicated by an arrow mark A of FIG. 1
Figure 3B:
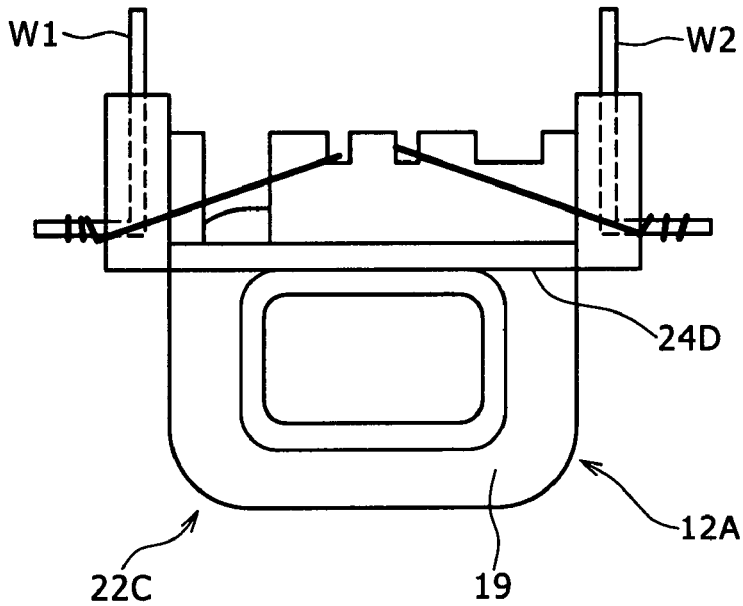
FIG. 3B is a view showing the transformer as viewed in the direction indicated by an arrow mark B of FIG. 1.
Figure 8:
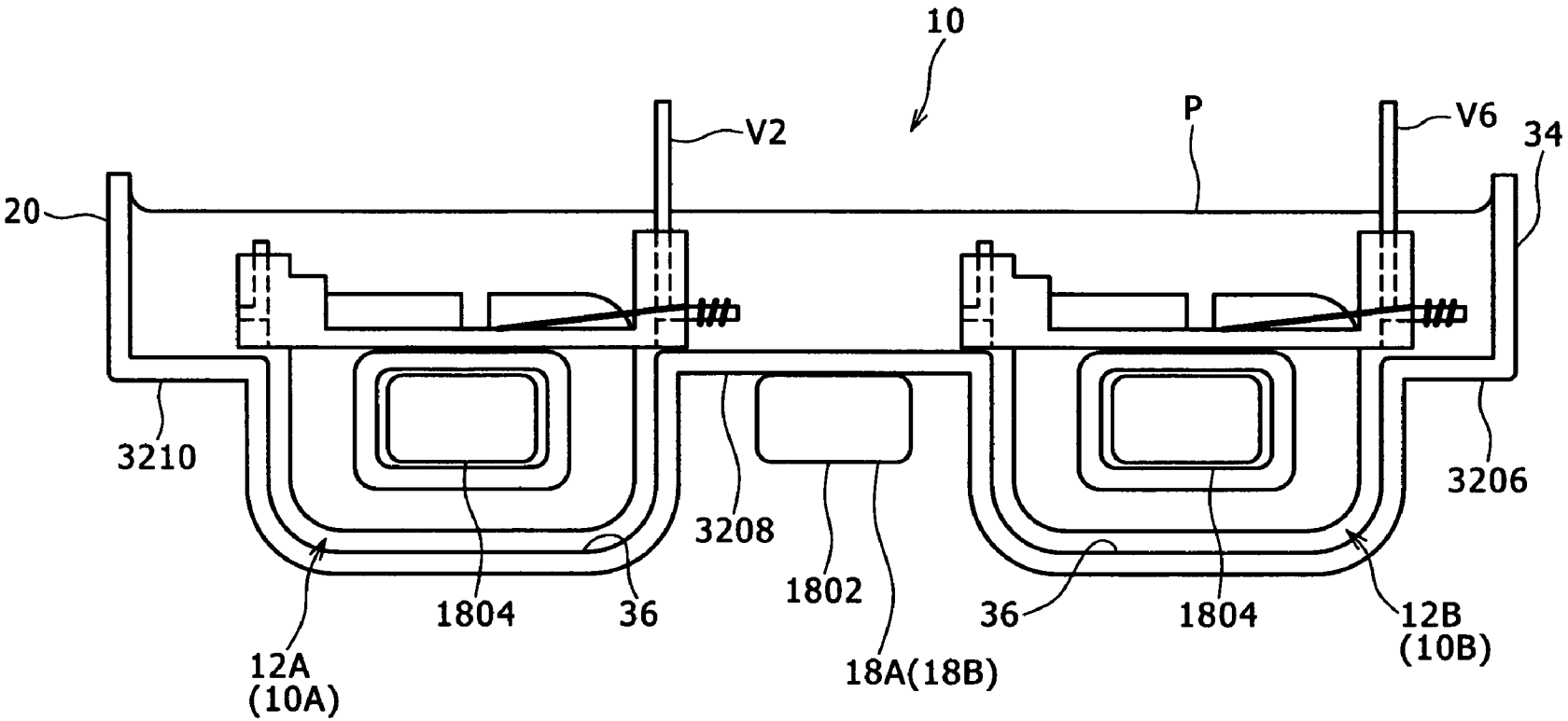
FIG. 8 is a sectional view of the transformer taken along line A-A in FIG. 1.

The first to fourth plate portions 24A, 24B, 24C and 24D are provided in a contacting relationship with the first to third cylindrical portions 22A, 22B and 22C as seen in FIGS. 3 and 8.

A plurality of flanges 19 for defining the position of a winding and the dimension of the winding in the axial direction are provided in a spaced relationship from each other in the axial direction of the cylindrical portions 22A, 22B and 22C on the first to third cylindrical portions 22A, 22B and 22C.

The fourth plate portion 24D is formed with a length greater than that of the first to third cylindrical portions 22A, 22B and 22C.

The second cylindrical portion 22B is used as a primary winding receiving cylindrical portion 26 and the first and third cylindrical portions 22A and 22C are used as secondary winding receiving cylindrical portions 28 and 30, respectively.

In the first bobbin 12A, the first primary winding 14A is wound on the primary winding receiving cylindrical portion 26 to form the first primary winding receiving portion 15A. Further, the first secondary winding 16A is wound on the secondary winding receiving cylindrical portion 28 from between the two secondary winding receiving cylindrical portions 28 and 30 to form the first secondary winding receiving portion 17A. Meanwhile, the second secondary winding 16B is wound on the secondary winding receiving cylindrical portion 30 from between the secondary winding receiving cylindrical portions 28 and 30 to form the second secondary winding receiving section 17B.

In the first bobbin 12A, terminals w1 and w2 to which the opposite ends of the first primary winding 14A are to be connected are provided at the opposite sides of an end portion of the fourth plate portion 24D, respectively.

Further, in the first bobbin 12A, terminals v1 and v2 to which the opposite ends of the first secondary winding 16A are to be connected are provided at an end portion of the first plate portion 24A and an end portion of the second plate portion 24B, respectively.

Further, in the first bobbin 12A, terminals v3 and v4 to which the opposite ends of the second secondary winding 16B are to be connected are provided at an end of portion of the third plate portion 24C and an end portion of the fourth plate portion 24D, respectively.

In the second bobbin 12B, the second primary winding 14B is wound on the first winding receiving cylindrical portion 26 to form the second primary winding receiving portion 15B. Further, the third secondary winding 16C is wound on the secondary winding receiving cylindrical portion 28 from between the two secondary winding receiving cylindrical portions 28 and 30 to form the third secondary winding receiving portion 17C. Meanwhile, the fourth secondary winding 16D is wound on the secondary winding receiving cylindrical portion 30 from between the secondary winding receiving cylindrical portions 28 and 30 to form the fourth secondary winding receiving portion 17D.

In the second bobbin 12B, terminals w3 and w4 to which the opposite ends of the second primary winding 14B are to be connected are provided at the opposite ends of the plate portion 24D spaced from the cylindrical portion 22C across the axis.

Further, in the second bobbin 12B, terminals v5 and v6 to which the opposite ends of the third secondary winding 16C are to be connected are provided at two locations of end portions of the cylindrical portion 22A spaced from the primary winding receiving cylindrical portion 26.

Further, in the second bobbin 12B, terminals v7 and v8 to which the opposite ends of the fourth secondary winding 16D are to be connected are provided at the opposite ends in a longitudinal direction of the secondary winding receiving cylindrical portion 30 on which the fourth secondary winding 16D is wound.

It is to be noted that the windings are hardened by impregnating and filling insulating varnish of epoxy resin, polyester resin or the like after they are wound on the respective winding receiving cylindrical portions.

In the present embodiment, the transformer 10 is formed from two transformers including a first transformer 10A formed from the first primary wiring 14A and the first and second secondary windings 16A and 16B and a second transformer 10B formed from the second primary winding 14B and the third and fourth secondary windings 16C and 16D. The first and second secondary windings 14A and 14B are directly connected to the transformer 10. In other words, the first and second transformers 10A and 10B correspond to the transformer according to the present invention.

In the first bobbin 12A, a gap G is provided between the first primary winding receiving portion 15A and the first secondary winding receiving portion 17A along the axis.

Another gap G is provided between the first primary winding receiving portion 15A and the second secondary winding receiving portion 17B along the axis. The gaps G are formed in an equal size.

Meanwhile, in the second bobbin 12B, a gap G is provided between the second primary winding receiving portion 15B and the third secondary winding receiving portion 17C along the axis. Another gap G is provided between the second primary winding receiving portion 15B and the fourth secondary winding receiving portion 17D along the axis. The gaps G are formed in an equal size.

In the present embodiment, all of the gaps G of the first bobbin 12A and the gaps G of the second bobbin 12B are formed in an equal size.

Referring to FIG. 2, the case 20 has a bottom plate 32 having a rectangular shape as viewed in plan and a side wall 34 erected uprightly from the four side edges of the bottom plate 32.

In the present embodiment, the case 20 is formed from a synthetic resin material having an insulation characteristic, and, for example, modified PPO can be applied as the synthetic resin material.

Two concave portions 36 for bobbin accommodation are provided in a spaced relationship from each other in a direction perpendicular to the longitudinal direction of the bottom plate 32 at an intermediate portion in the longitudinal direction of the bottom plate 32.

By the provision of the two concave portions 36, a first plate portion 3202 placed at one end in an extending direction of the concave portions 36, a second plate portion 3204 placed at the other end in the extending direction of the concave portions 36, and third to fifth plate portions 3206, 3208 and 3210 provided between the opposites side portions of the side wall 34 and the two concave portions 36 are formed on the bottom plate 32.

Figure 4:
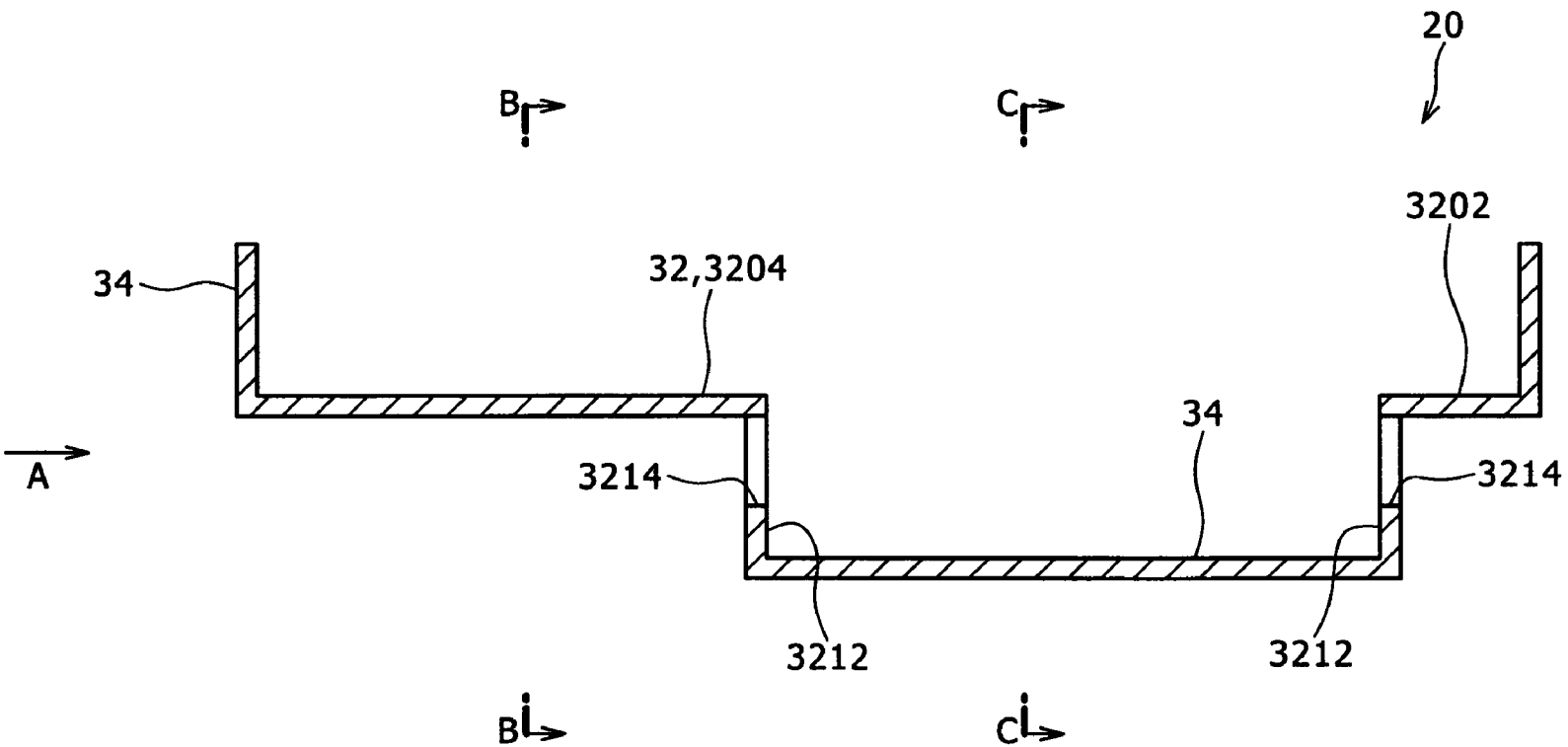
FIG. 4 is a sectional view taken along line Y-Y in FIG. 1.
Figure 5:
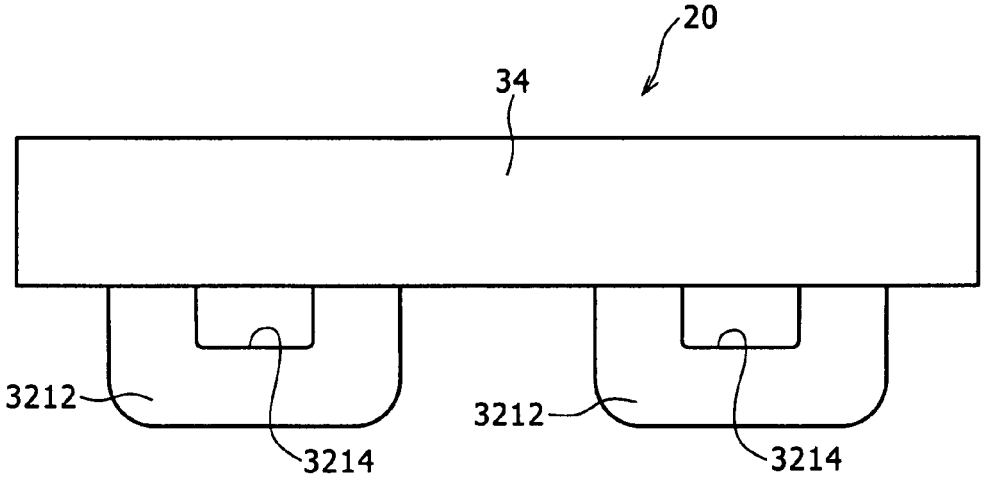
FIG. 5 is a view showing the transformer as viewed in the direction indicated by an arrow mark A of FIG. 4.
Figure 6:
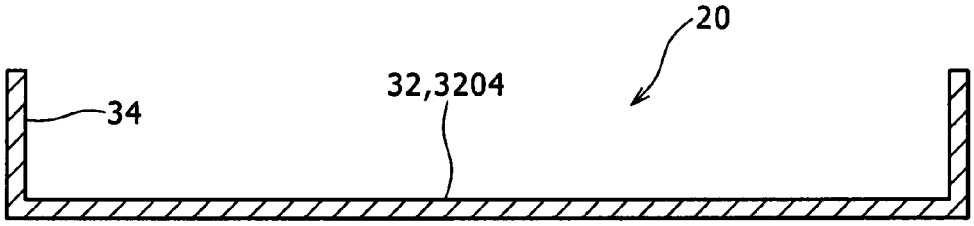
FIG. 6 is a sectional view taken along line B-B of FIG. 4.
Figure 7:
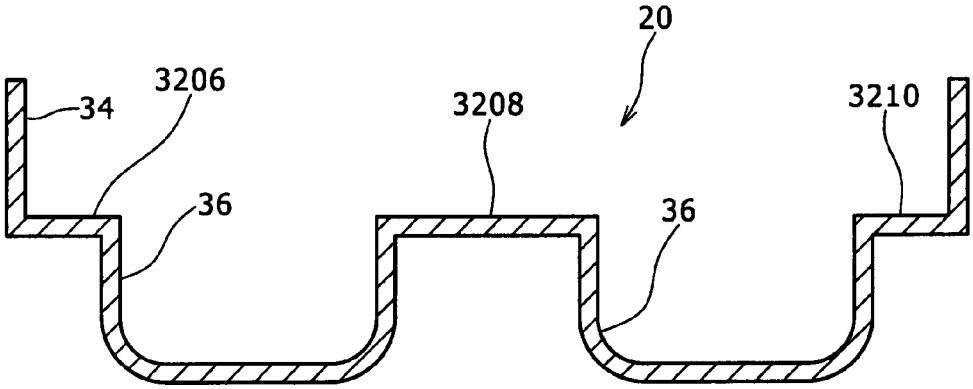
FIG. 7 is a sectional view taken along line C-C of FIG. 4.

Referring to FIGS. 4 and 5, an opening 3214 for allowing an core to be inserted therethrough is formed in each of wall portions 3212 at the opposite ends in the extending direction of each of the concave portions 36.

Referring to FIG. 1, the cores 18A and 18B individually have an E-shape and are formed, in the present embodiment, from ferrite.

The cores 18A and 18B individually have a central magnetic leg portion 1802 to be disposed below the fourth plate portion 3208 and outer magnetic leg portions 1804 to be inserted from the openings 3214 into the first to third cylindrical portions 22A, 22B and 22C in the concave portions 36.

The central magnetic leg portion 1802 is formed in such a size that the central magnetic leg portions 1802 of the cores 18A and 18B contact the free ends thereof with each other in a state wherein they are inserted along the fourth plate portion 3208 between the concave portions 36 from the opposite ends in the longitudinal direction of the concave portions 36.

The outer magnetic leg portions 1804 are formed in such a size that they contact the free ends thereof with each other in a state wherein they are inserted in the concave portion 36 through the openings 3214 at the opposite ends in the longitudinal direction of the concave portion 36.

Referring to FIG. 2, the first primary winding receiving portion 15A, first secondary winding receiving portion 17A and second secondary winding receiving portion 17B of the first bobbin 12A are accommodated in one of the concave portions 36.

The second primary winding receiving portion 15B, third secondary winding receiving portion 17C and fourth secondary winding receiving portion 17D of the second bobbin 12B are accommodated in the other one of the concave portions 36.

The first bobbin 12A is disposed such that the terminal v1 is placed at the first plate portion 3202 and the terminals v2 and v3 are placed at the fourth plate portion 3208, and the terminals v4, w1 and w2 are placed at the second plate portion 3204.

Further, in the second bobbin 12B, the terminal v5 is placed at the first plate portion 3202 and the terminals v6 and v7 are placed at the third plate portion 3206, and the terminals v8, w3 and w4 are placed at the second plate portion 3204.

Now, the cores 18A and 18B are inserted along the axial direction of the windings from the opposite ends in the longitudinal direction of the concave portions 36 through the openings 3214 and below the bottom face of the fourth plate portion 3208. The central magnetic leg portions 1802 and the outer magnetic leg portions 1804 of the two cores 18A and 18B are contacted at the free ends thereof with each other with a core spacer, silicone thermosetting adhesive or the like interposed therebetween. Consequently, a magnetic path which passes the central magnetic leg portions 1802 and the outer magnetic leg portions 1804 is formed. Then, after the assembly is left at a high temperature (for example, 105° C.) for hardening of the silicone adhesive described above and for drying of the primary winding 14 and the secondary windings 16, epoxy resin P in a molten state is poured into the concave portions 36 and onto the bottom plate 32 so that the first and second bobbins 12A and 12B are sealed as shown in FIG. 8.

Figure 9:
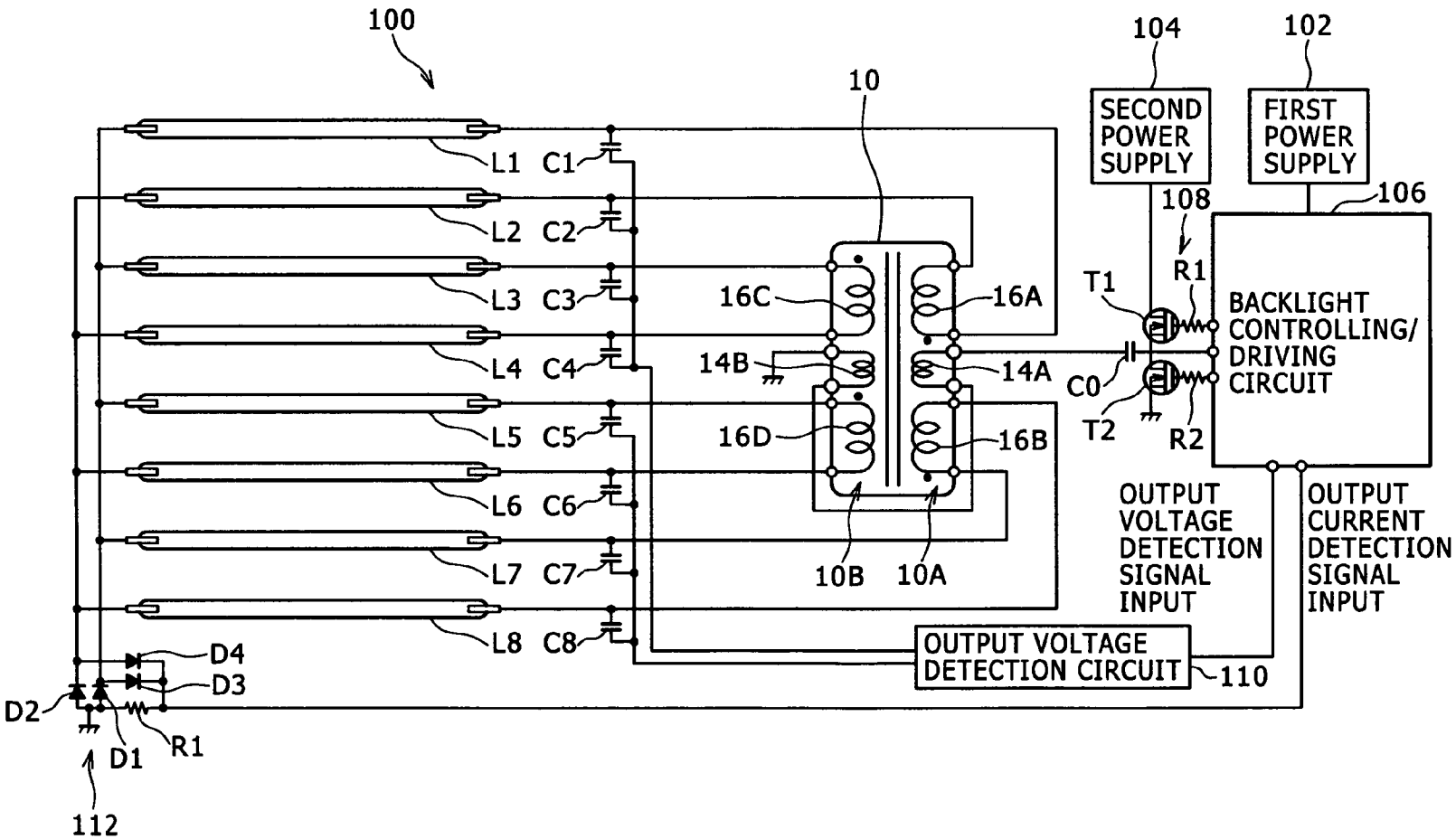
FIG. 9 is a circuit diagram showing a configuration of a backlight apparatus in which the transformer is used.

FIG. 9 is a circuit diagram showing a configuration of a backlight apparatus 100 in which the transformer 10 is incorporated.

Referring to FIG. 9, the backlight apparatus 100 includes cathode-fluorescent lamps L, a transformer 10, a first power supply 102, a second power supply 104, a backlight controlling/driving circuit 106, a switching circuit 108, an output voltage detection circuit 110, an output current detection circuit 112 and so forth.

The cathode-fluorescent lamps L includes first to eighth cathode-fluorescent lamps L1 to L8, which are individually formed from a cold cathode fluorescent lamp (CCFL) and emit light in accordance with a high-frequency voltage supplied thereto from the transformer 10.

The first power supply 102 supplies DC power for operation to the backlight controlling/driving circuit 106.

The second power supply 104 supplies a DC voltage to the switching circuit 108.

The switching circuit 108 switches the DC voltage supplied thereto from the second power supply 104 in accordance with a driving signal from the backlight controlling/driving circuit 106 to generate a first high-frequency voltage.

In the present embodiment, the switching circuit 108 includes two switching transistors (FETS) T1 and T2, resistances R1 and R2, and a capacitor C0.

The transistor T1 from between the two transistors T1 and T2 is connected at the drain thereof to an output terminal of the second power supply 104 and at the source thereof to the drain of the other transistor T2 such that an output terminal of the switching circuit is formed meanwhile, the transistor T2 is connected at the source thereof to the ground.

If a driving signal (switching signal) from the backlight controlling/driving circuit 106 is supplied to the gates of the transistors T1 and T2 through the resistance R1 and R2, then the transistors T1 and T2 are switched on and off alternately. Consequently, the first high-frequency voltage is supplied from the output terminal of the switching circuit to the transformer 10 through a capacitor C0.

One end of the first primary winding 14A of the transformer 10 is used as an input terminal to which the first high frequency voltage from the switching circuit 108 (capacitor C0) is inputted. The first primary winding 14A is connected at the other end thereof to an end of the second primary winding 14B, which is grounded at the other end thereof. In other words, the first primary winding 14A and the second primary winding 14B are connected in series.

The first secondary winding 16A of the transformer 10 is connected at one end thereof to one of electrodes of the first cathode fluorescent lamp L1 and at the other end thereof to one of electrodes of the second cathode fluorescent lamp L2.

The second secondary winding 16B of the transformer 10 is connected at one end thereof to one of electrodes of the seventh cathode fluorescent lamp L7 and at the other end thereof to one of electrodes of the eighth cathode fluorescent lamp L8.

The third secondary winding 16C of the transformer 10 is connected at one end thereof to one of electrodes of the third cathode fluorescent lamp L3 and at the other end thereof to one of electrodes of the fourth cathode fluorescent lamp L4.

The fourth secondary winding 16D of the transformer 10 is connected at one end thereof to one of electrodes of the fifth cathode fluorescent lamp L5 and at the other end thereof to one of electrodes of the sixth cathode fluorescent lamp L6.

The output current detection circuit 112 detects current flowing from the transformer 10 to the cathode fluorescent lamps L and includes first to fourth diodes D1, D2, D3 and D4 and a resistor R1.

In particular, the first, third, fifth and seventh cathode fluorescent lamps L1, L3, L5 and L7 are grounded at the other electrode thereof through the first diode D1 and the third diode D3.

More particularly, the first diode D1 is connected at the cathode thereof to the other electrodes of the cathode fluorescent lamps L1, L3, L5 and L7 and grounded at the anode thereof.

The third diode D3 is connected at the anode thereof to the other electrode of the cathode fluorescent lamps L1, L3, L5 and L7 and grounded at the cathode thereof through the resistor R1.

Meanwhile, the second, fourth, sixth and eighth cathode fluorescent lamps L2, L4, L6 and L8 are grounded at the other electrode thereof through the second diode D2 and the fourth diode D4.

More particularly, the second diode D2 is connected at the cathode thereof to the other electrode of the cathode fluorescent lamps L2, L4, L6 and L8 and grounded at the anode thereof.

The fourth diode D4 is connected at the anode thereof to the other electrode of the cathode fluorescent lamps L2, L4, L6 and L8 and grounded at the cathode thereof through the resistor R1.

The resistor R1 is connected at one end thereof to the backlight controlling/driving circuit 106 such that the sum total of current (output current) flowing to the cathode fluorescent lamps L1 to L8 through the third and fourth diodes D3 and D4 is detected as a voltage across the resistor R1 by the backlight controlling/driving circuit 106.

The first high frequency voltage supplied from the switching circuit 108 to the transformer 10 is converted into a second high frequency voltage higher than the first high frequency voltage and supplied to the cathode fluorescent lamps L1 to L8. Accordingly, current is supplied to the cathode fluorescent lamps L1 to L8, and the cathode fluorescent lamps L1 to L8 are energized to emit light.

Accordingly, in the present embodiment, a high frequency voltage production section is formed from the first and second power supplies 102 and 104, backlight controlling/driving circuit 106 and switching circuit 108.

In particular, since a pair of cathode fluorescent lamps are connected to the opposite ends of one secondary winding, the two cathode fluorescent lamps are connected in series to the one secondary winding. Accordingly, equal current flows through the two cathode-fluorescent lamps. Thereupon, a neutral point which appears at a mid point of each secondary winding varies a little so that equal current may flow through the two cathode fluorescent lamps. Accordingly, the voltages applied to the two loads (cathode fluorescent lamps) are not equal to each other, and automatic control is performed so that equal current flows through the two loads.

At this time, it is assumed that a pair of circuits connecting to the opposite ends of each secondary winding 16 centered at the neutral point and each including all elements such as a capacitor and a cathode fluorescent lamp have frequency characteristics proximate to each other.

It is to be noted that, in the present embodiment, as seen in FIG. 9, the first and second secondary windings 16A and 16B are wound so as to have the same polarity and the third and fourth secondary windings 16C and 16D are wound so as to have the same polarity while the polarity of the first and second secondary windings 16A and 16B and the polarity of the third and fourth secondary windings 16C and 16D are opposite to each other. In other words, the first and second secondary windings 16A and 16B are wound in the same direction with each other and the third and fourth secondary windings 16C and 16D are wound in the same direction with each other while the first and second secondary windings 16A and 16B and the third and fourth secondary windings 16C and 16D are wound in the opposite directions to each other.

Further, the phase of the second high frequency voltage applied to the first, third, fifth and seventh cathode fluorescent lamps L1, L3, L5 and L7 and the phase of the second high frequency voltage applied to the second, fourth, sixth and eighth cathode fluorescent lamps L2, L4, L6 and L8 are opposite to each other.

Here, the cathode fluorescent lamps L1 to L8 are juxtaposed in parallel to each other in this order. In other words, the phases of the second high frequency voltages applied to adjacent ones of the cathode fluorescent lamps L are opposite to each other.

Where the phases of the second high frequency voltages are opposite to each other between adjacent ones of the cathode fluorescent lamps L in this manner, noise signals superposed on the second high frequency voltages cancel each other, which is advantageous in achievement of noise reduction.

The output voltage detection circuit 110 detects the first voltage E1 from one electrode of the first to fourth cathode fluorescent lamps L1 to L4 through the capacitors C1 to C4 and detects the second voltage E2 from the one electrode of the fifth to eighth cathode fluorescent lamps L5 to L8 through the capacitors C5 to C8.

The output voltage detection circuit 110 compares the first voltage E1 and the second voltage E2 with each other and supplies an output voltage detection signal representative of whether or not the voltages E1 and E2 coincide with each other to the backlight controlling/driving circuit 106.

The backlight controlling/driving circuit 106 controls on and off periods of the switching circuit 108 based on the sum total of current flowing through the cathode fluorescent lamps L1 to L8 detected using the output current detection circuit 112 to perform feedback control so that the sum total of the current may be kept at a fixed value, that is, the brightness of the cathode fluorescent lamps may be uniform.

Further, the backlight controlling/driving circuit 106 decides based on the output voltage detection signal from the output voltage detection circuit 110 that the cathode fluorescent lamps are in a normal state if the voltages E1 and E2 coincide with each other. However, if the voltages E1 and E2 do not coincide with each other, then the backlight controlling/driving circuit 106 decides that some abnormal state such as failure in lighting of some of the cathode fluorescent lamps has occurred, and stops operation of the switching circuit 108.

Now, the gap G of the transformer 10 is described in detail.

Conventionally, in a transformer of the type described, in order to suppress the loss and assure a high efficiency, it is preferable to set the coupling coefficient K between a primary winding and a secondary winding to a value as near to 1 as possible. Accordingly, the gap between a primary winding receiving portion on which the primary winding is wound and a secondary winding receiving portion on which the secondary winding is wound is set within 4 mm.

It is considered here to provide a plurality of secondary windings for one primary winding in a transformer, which has such a high coupling coefficient K as mentioned above, and connect a cathode fluorescent lamp to each of the secondary windings.

In this instance, if variation of a characteristic occurs with one of the cathode fluorescent lamps and varies the current, then the variation of the current has a high influence from the secondary winding connected to the cathode fluorescent lamp on the other secondary winding through the primary winding. This is because the coupling coefficient is proximate to 1 as described above.

In order to suppress such a disadvantage as just described, conventionally a balance transformer, a balance capacitor or the like is provided between each primary winding and the corresponding cathode fluorescent lamp and the impedance of the entire circuit including the transformer and the balance transformer or balance capacitor as viewed from the load side is set to a high value. Consequently, even if variation occurs with the current through the cathode fluorescent lamp, in other words, even if variation of the impedance occurs, the variation amount is suppressed to a low value relative to the impedance of the entire circuit thereby to suppress the influence of the variation of the current through the cathode fluorescent lamp on the other cathode fluorescent lamp.

In contrast, in the present embodiment, the function achieved by the balance transformer or the balance capacitor described above is achieved by the inside of the transformer 10.

In particular, in the present embodiment, the gaps G between the primary winding receiving portion 15 and the two secondary winding receiving portions 17 are both formed with a dimension greater than a first predetermined value G0 so that the coupling coefficients K between the primary winding 14 and the two secondary windings 16 are set lower than a second predetermined value K0 by the gaps G0.

By the configuration just described, in the first transformer 10A, impedance is formed intentionally between the first primary winding 14A and the first and second secondary windings 16A and 16B, and in the second transformer 10B, impedance is formed intentionally between the second primary winding 14B and the third and fourth secondary windings 16C and 16D. Accordingly, the impedance of the transformers 10A and 10B as viewed from the load side is set to high values.

Here, even if variation of the impedance of the load side is caused by variation which occurs in the current flowing through any of the cathode fluorescent lamps L, the variation amount is small when compared with the impedance of the entire circuit including the transformer and the loads. Accordingly, even if variation occurs with the current through one of the cathode fluorescent lamps L, the influence of the variation on the other cathode fluorescent lamps L is suppressed.

For example, in the first transformer 10A, even if variation occurs with the current of the first cathode fluorescent lamp L1, the influence of the variation of the current to be had on the current of the remaining second, seventh and eighth cathode fluorescent lamps L2, L7 and L8 connected to the first transformer 10A is suppressed, and the current of the first, second, seventh and eighth cathode fluorescent lamps L1, L7 and L8 is kept fixed and the brightness of the cathode fluorescent lamps L is kept fixed.

Similarly, for example, in the second transformer 10B, even if variation occurs with the current of the third cathode fluorescent lamp L3, the influence of the variation of the current to be had on the current of the remaining fourth, fifth and sixth cathode fluorescent lamps L4, L5 and L6 connected to the second transformer 10B is suppressed, and the current of the third, fourth, fifth and sixth cathode fluorescent lamps L3, L4, L5 and L6 is kept fixed and the brightness of the cathode fluorescent lamps L is kept fixed.

Now, magnetic paths formed by the two cores 18A and 18B are described in detail.

In the present embodiment, since the outer magnetic leg portions 1804 of one of the cores 18A and 18B pass along the axis of the first primary winding receiving portion 15A and first and second secondary winding receiving portions 17A and 17B of the first bobbin 12A, a first magnetic path is formed from the one of the outer magnetic leg portions 1804 and the central magnetic leg portion 1802.

Meanwhile, the outer magnetic leg portions 1804 of the other one of the cores 18A and 18B pass through the second primary winding receiving portion 15B and the third and fourth secondary winding receiving portions 17C and 17D of the second bobbin 12B. Therefore, a second magnetic path is formed from the other one of the outer magnetic leg portions 1804 and the central magnetic leg portion 1802.

Accordingly, since the first and second paths are separated from each other by the existence of the central magnetic leg portion 1802, the coupling between the magnetic circuits of the first transformer 10A and the second transformer 10B is weak.

Consequently, the coupling coefficient K between the first primary winding 14A of the first transformer 10A and the third and fourth secondary windings 16C and 16D of the second transformer 10B becomes as low as substantially 0.6. Accordingly, impedance is formed intentionally between the first primary winding 14A of the first transformer 10A and the third and fourth secondary windings 16C and 16D of the second transformer 10B.

Similarly, also the coupling coefficient K between the second primary winding 14B of the second transformer 10B and the first and second secondary windings 16A and 16B of the first transformer 10A becomes as low as substantially 0.6. Accordingly, impedance is formed intentionally between the second primary winding 14B of the second transformer 10B and the first and second secondary windings 16A and 16B of the first transformer 10A.

Accordingly, in regard to the relationship between the first transformer 10A and the second transformer 10B, the impedance of the transformers 10A and 10B as viewed from the load side exhibits a high value. Thus, similarly as described above, even if variation of the impedance of the load side is caused by variation of the current of any of the cathode fluorescent lamps L, the variation amount is low when compared with the impedance of the entire circuit including the transformers 10A and 10B and the loads.

Accordingly, even if variation occurs with the current of one of the cathode fluorescent lamps L connected to the transformers 10A and 10B, the influence of the variation of the current to be had on the other cathode fluorescent lamp L connected to the other one of the transformers 10A and 10B is suppressed.

It is to be noted that, although also it is possible to adopt an core which does not have the central magnetic leg portion 1802 but has only the two outer magnetic leg portions 1804, in this instance, the coupling coefficient K described above becomes substantially 0.9, and it is difficult to form such intentional impedance as described above. Accordingly, when compared with the case where the E-shaped cores 18A and 18B are used, it is difficult to achieve the effect described above.

Particular examples of the first predetermined value G0 and the second predetermined value K0 are described based on a result of an experiment.

Figure 10:
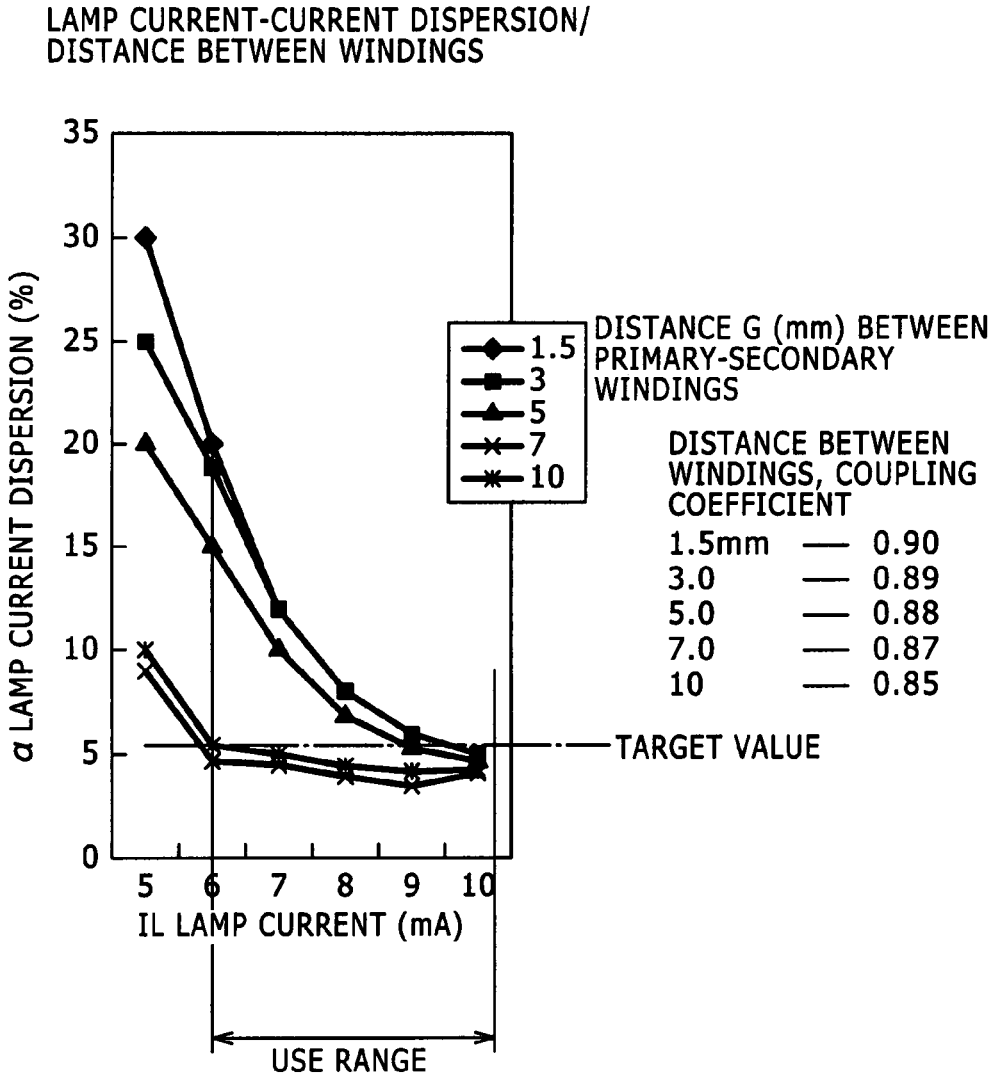
FIG. 10 is a graph illustrating a result of a measurement of current (lamp current) in a cathode lamp and a dispersion of the current when a gap and a connection coefficient are varied.

FIG. 10 illustrates a result of measurement of the current (lamp current) IL of a cathode fluorescent lamp L and the dispersion a of the current where the gap G and the coupling coefficient K are varied, and FIG. 11 illustrates data of the result of the measurement.

In the example illustrated, the measurement was performed varying the gap G (distance between the primary winding receiving portion 15 and each secondary winding receiving portion 17) among 1.5 mm, 3.0 mm, 5.0 mm, 7.0 mm and 10 mm as seen in FIGS. 10 and 11. It is to be noted that the values of the coupling coefficient K corresponding to the values of the gap G are 0.9, 0.89, 0.88, 0.87 and 0.85.

Further, in the cathode fluorescent lamps L used in the present example, the current IL in normal use ranges from 6 mA to 10 mA.

As can be seen apparently from FIG. 10, if the gap G is set to 7 mm or 10 mm (coupling coefficient K is 0.87 or 0.85), then the dispersion a of the current is lower than 5% within the range of the lamp current IL in normal use.

Meanwhile, if the gap G is set to 5 mm (coupling coefficient K is 0.88), then the dispersion a of the current is higher than 5% but lower than 15% in normal use.

However, if the gap G is set to 3 mm or 1.5 mm (coupling coefficient K is 0.89 or 0.90), then the dispersion $\alpha$ of the current is higher than 5% but lower than 20% within the range of the current in normal use.

From the result of the measurement given above, in order to suppress the dispersion $\alpha$ of the current lower than 15% within the range of the current in normal use, preferably the first predetermined value G0 of each gap G is set greater than 5 mm and the second predetermined value K0 of the coupling coefficient K is set lower than 0.88.

Further, in order to suppress the dispersion a of the current lower than 5% within the range of the current in normal use, preferably the first predetermined value G of the gaps G is set to a value more than 7 mm and the second predetermined value K0 of the coupling coefficient K is set to a value lower than 0.87.

It is to be noted that the upper limit to the first predetermined value G0 is approximately 10 mm. This is a value necessary to supply a second high frequency voltage, which is sufficient to drive the cathode fluorescent lamps L, from the secondary windings 16A, 16B and 16C, 16D of the transformers 10A and 10B to the cathode fluorescent lamps L.

Further, the lower limit to the second predetermined value K0 is 0.5 from the definition (calculation expression) of the coupling coefficient K.

It is to be noted that, in the present embodiment, the coupling coefficient K of a transformer is represented by the following expression (1):

$$K=(1-(L_O/L_S))^{0.5} \quad (1)$$

where $L_O$ is the inductance as viewed from the primary winding 14 side where the opposite ends of the secondary winding 16 are open, and $L_S$ is the inductance as viewed from the primary winding 14 side where the opposite ends of the secondary winding 16 are short-circuited.

According to the present embodiment, the gaps G between the primary winding receiving portion 15 and the two secondary winding receiving portions 17 are formed with a dimension greater than the first predetermined value G0 so that the coupling coefficients K between the first primary winding 14A and the first and second secondary windings 16A and 16B are set lower than the second predetermined value K0 by the gaps G0 thereby to suppress the influence of the variation of the current flowing through the cathode fluorescent lamps L1 to L8 connected to the secondary windings 16A to 16D on the other cathode fluorescent lamps L.

Accordingly, it is possible to allow the plural cathode fluorescent lamps L to emit light with uniform brightness without using a balance transformer or a balance capacitor as in the conventional transformer. Consequently, reduction in cost and downsizing of the transformer can be anticipated.

It is to be noted that, in the present embodiment described above, a pair of cathode fluorescent lamps L are connected individually to the opposite ends of each secondary winding 16 such that the two cathode fluorescent lamps L are driven by the single secondary winding 16.

However, also it is possible to connect one cathode fluorescent lamp L to one end of each secondary winding 16 and ground the other end of the secondary winding 16 such that the single cathode fluorescent lamp L is driven by the single secondary winding 16.

Accordingly, where n transformers according to the present invention are used, according to the configuration wherein two cathode fluorescent lamps L are connected to one secondary winding 16, the number of cathode fluorescent lamps L which can be driven by the transformer is 4n=4, 8, 12, . . . .

Further, where n transforms of the present invention are used, in a configuration wherein one cathode fluorescent lamp L is connected to one secondary winding 16, the number of cathode fluorescent lamps which can be driven by the transformer is 2n=2, 4, 6, . . . .

From the foregoing, the number of cathode fluorescent lamps L which can be driven where n transformers of the present invention are used is 2n=2, 4, 8, 10, 12, . . . .

It is to be noted that, in the present embodiment, the first transformer 10A is configured such that the distance between the terminals w1 and w2 of the primary winding 14 and the terminals v1 to v4 of the secondary windings 16 is set greater than the prescribed dimension d so as to satisfy the safety standards.

Meanwhile, the second transformer 10B is configured such that the distance between the terminals w3 and w4 of the primary winding 14 and the terminals v5 to v8 of the secondary windings 16 is set greater than the prescribed dimension d so as to satisfy the safety standards.

The dimension d of the safety standards is represented by the following expression (2):

$$\log d=0.78 \log(V/300) \quad (2)$$

It is to be noted that, by rewriting d in the expression (2) into 2d, the safety standards which assure a high insulating property as an isolating type transformer can be satisfied.

Second Embodiment

Now, a second embodiment of the present invention is described.

Figure 12:
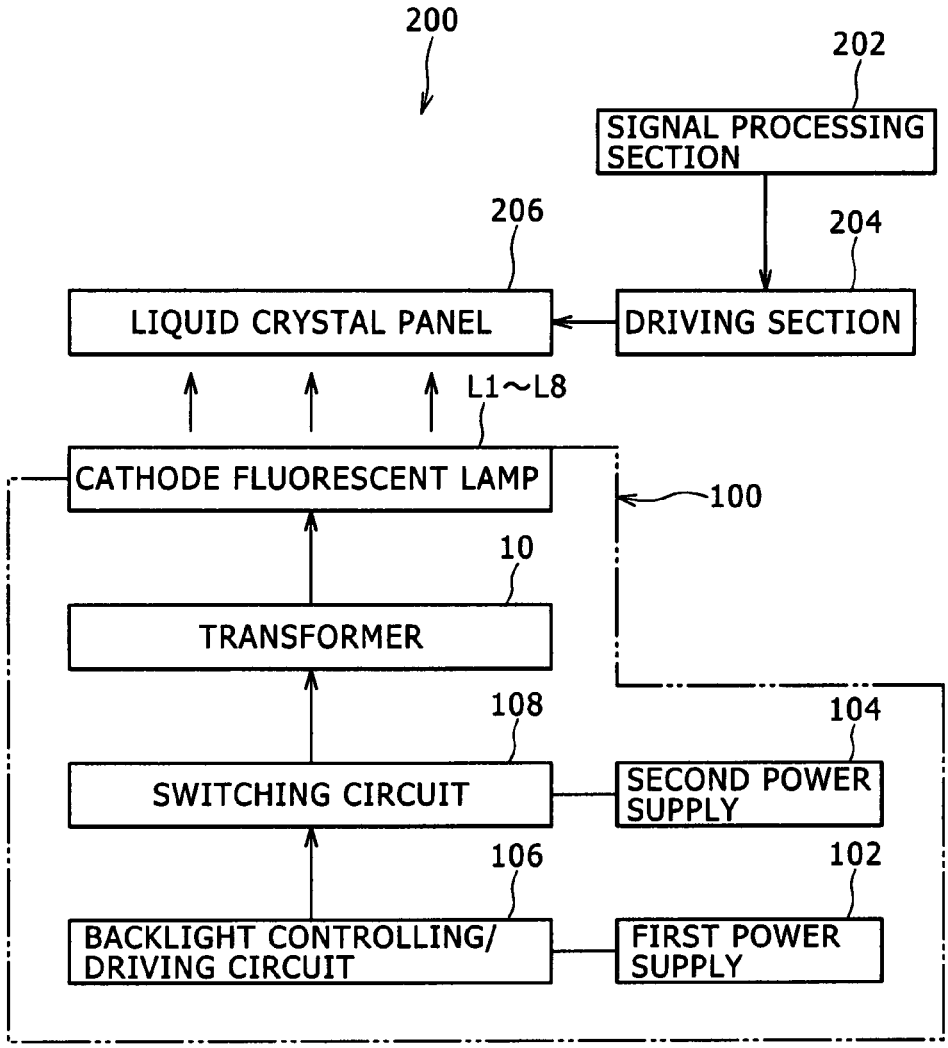
FIG. 12 is a block diagram showing a configuration of a display apparatus according to a second embodiment of the present invention.

FIG. 12 shows a configuration of a display apparatus 200 according to the second embodiment of the present invention.

In the present second embodiment, the backlight apparatus 100 of the first embodiment is used to configure the display apparatus 200.

The display apparatus 200 shown includes a signal processing section 202, a driving section 204, a liquid crystal display panel 206, and a backlight apparatus 100.

The signal processing section 202 processes an image signal supplied thereto from the outside of the display apparatus 200 or from an image signal generation section not shown provided in the display apparatus 200 and supplies a resulting image signal to the driving section 204.

The driving section 204 generates a drive signal for driving the liquid crystal display panel 206 based on the image signal supplied thereto from the signal processing section 202 and supplies the produced driving signal to the liquid crystal display panel 206.

The liquid crystal display panel 206 includes two transparent glass substrates, a liquid crystal layer sandwiched between the two glass substrates, transparent electrodes provided on the inner faces of the glass substrates, color filters and polarizing plates and so forth not shown.

The backlight apparatus 100 has the configuration described hereinabove in connection with the first embodiment and drives the cathode fluorescent lamps L1 to L8 to emit light.

The cathode fluorescent lamps L1 to L8 are disposed in an opposing relationship to the liquid crystal display panel 206.

While illumination light from the cathode fluorescent lamps L1 to L8 is irradiated upon the liquid crystal display panel 206 from the rear side by the backlight apparatus 100, the driving signal is supplied to the liquid crystal display panel 206 to drive the liquid crystal of the liquid crystal layer to display an image.

Also in the display apparatus 200 having the configuration described above, use of the backlight apparatus 100 allows the plural cathode fluorescent lamps to emit light with uniform brightness similarly as in the first embodiment.

This is advantageous in reduction in cost and downsizing of the display apparatus 200.

Third Embodiment

Now, a third embodiment of the present invention is described.

Figure 13:
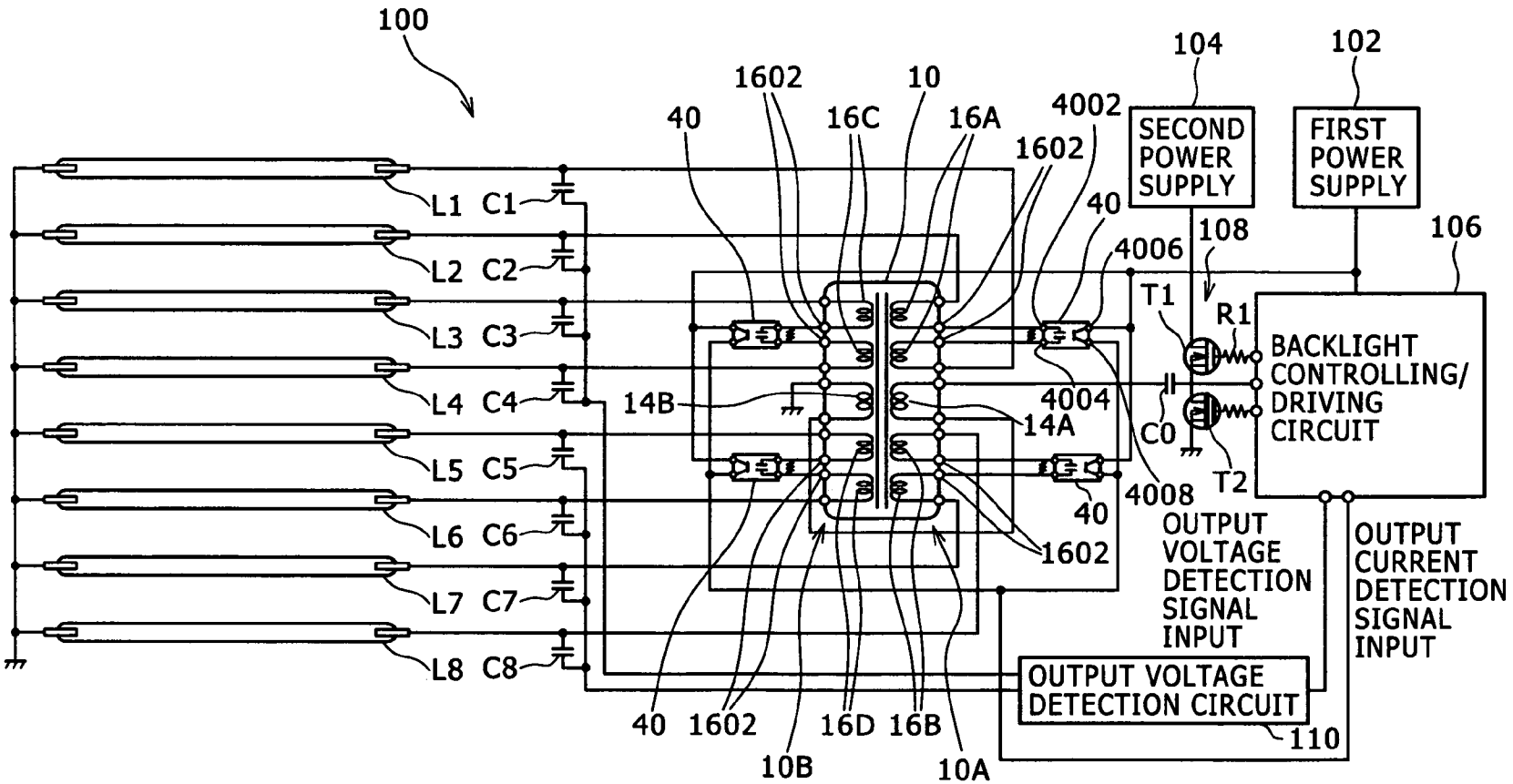
FIG. 13 is a block diagram showing a configuration of a backlight apparatus according to a third embodiment of the present invention.

FIG. 13 shows a configuration of the backlight apparatus 100 according to the third embodiment of the present invention.

The third embodiment is a modification to but is different from the first embodiment in a configuration for detecting output current supplied to the cathode fluorescent lamps L.

Referring to FIG. 13, the transformer 10 according to the third embodiment includes transformers 10A and 10B.

The first transformer 10A includes a first primary winding receiving portion 15A including a first primary winding 14A, and first and second secondary winding receiving portions 17A and 17B including first and second secondary windings 16A and 16B, respectively. Meanwhile, the second transformer 10B includes a second primary winding receiving portion 15B including a second primary winding 14B, and third and fourth secondary winding receiving portions 17C and 17D including third and fourth secondary windings 16C and 16D, respectively.

The first secondary winding 16A has two intermediate terminals 1602 provided at an intermediate portion thereof corresponding to a neutral point thereof.

Two input terminals 4002 and 4004 of a photo-coupler 40 are connected to the two intermediate terminals 1602.

An output voltage of the first power supply 102 is connected to the output terminal 4006 while the output terminal 4008 is connected to an input current detection signal input terminal of the backlight controlling/driving circuit 106.

Accordingly, current flowing through the first secondary winding 16A is detected by the backlight controlling/driving circuit 106 through the photo-coupler 40.

Also with regard to the second, third and fourth secondary windings 16B, 16C and 16D, two intermediate terminals 1602 are provided at an intermediate portion corresponding to a neutral point of the second, third and fourth secondary windings 16B, 16C and 16D, and two input terminals 4002 and 4004 of a photo-coupler 40 are connected to the intermediate terminals 1602.

The output terminal 4006 is connected to an output voltage of the first power supply 102 while the other output terminal 4008 is connected to the output current detection signal input terminal of the backlight controlling/driving circuit 106.

Accordingly, current flowing through the second, third and fourth secondary windings 16B, 16C and 16D is detected by the backlight controlling/driving circuit 106 through the respective photo-coupler 40.

The backlight controlling/driving circuit 106 controls the on and off periods of the switching circuit 108 based on the sum total of current of the secondary windings 16A, 16B, 16C and 16D to perform feedback control so that the sum total of the current may be kept at a fixed value, or in other words, the brightness of the cathode fluorescent lamps L may be kept fixed.

According to the present third embodiment, not only an effect similar to that achieved by the first embodiment is achieved, but also such an effect as described below is achieved.

In particular, in the third embodiment, the output current detection circuit 112 is used which detects the sum total of current flowing to the ground through a diode and a resistor from one terminal of the cathode fluorescent lamps L, different from the first embodiment.

Therefore, even where a structure is used wherein the electrodes of the cathode fluorescent lamps L are soldered directly to a substrate and consequently a diode or a resistor cannot be provided and the output current detection circuit 112 cannot be provided, it is possible to detect the current flowing through the cathode fluorescent lamps L to perform feedback control.

It is to be noted that, while theoretically the neutral point of the secondary winding 16 has a potential equal to the ground potential, even where equal current flows through two cathode fluorescent lamps L, a potential difference appears between the neutral point and the ground due to dispersion in characteristic of the cathode fluorescent lamps L. Therefore, if the intermediate terminals 1602 is connected to the ground, then the action of automatically adjusting the current to flow through the two cathode fluorescent lamps L described hereinabove in connection with the first embodiment does not operate.

Therefore, the current of each secondary winding 16 is detected in an isolated relationship from the ground using a photo-coupler 40. By this, the current can be detected accurately without being influenced by the potential difference described above.

Accordingly, only it is necessary to detect the current flowing through the neutral point of the secondary winding 16 in an isolated relationship from the ground, and a transformer may be used in place of the photo-coupler 40.

Fourth Embodiment

Now, a fourth embodiment of the present invention is described.

Figure 14:
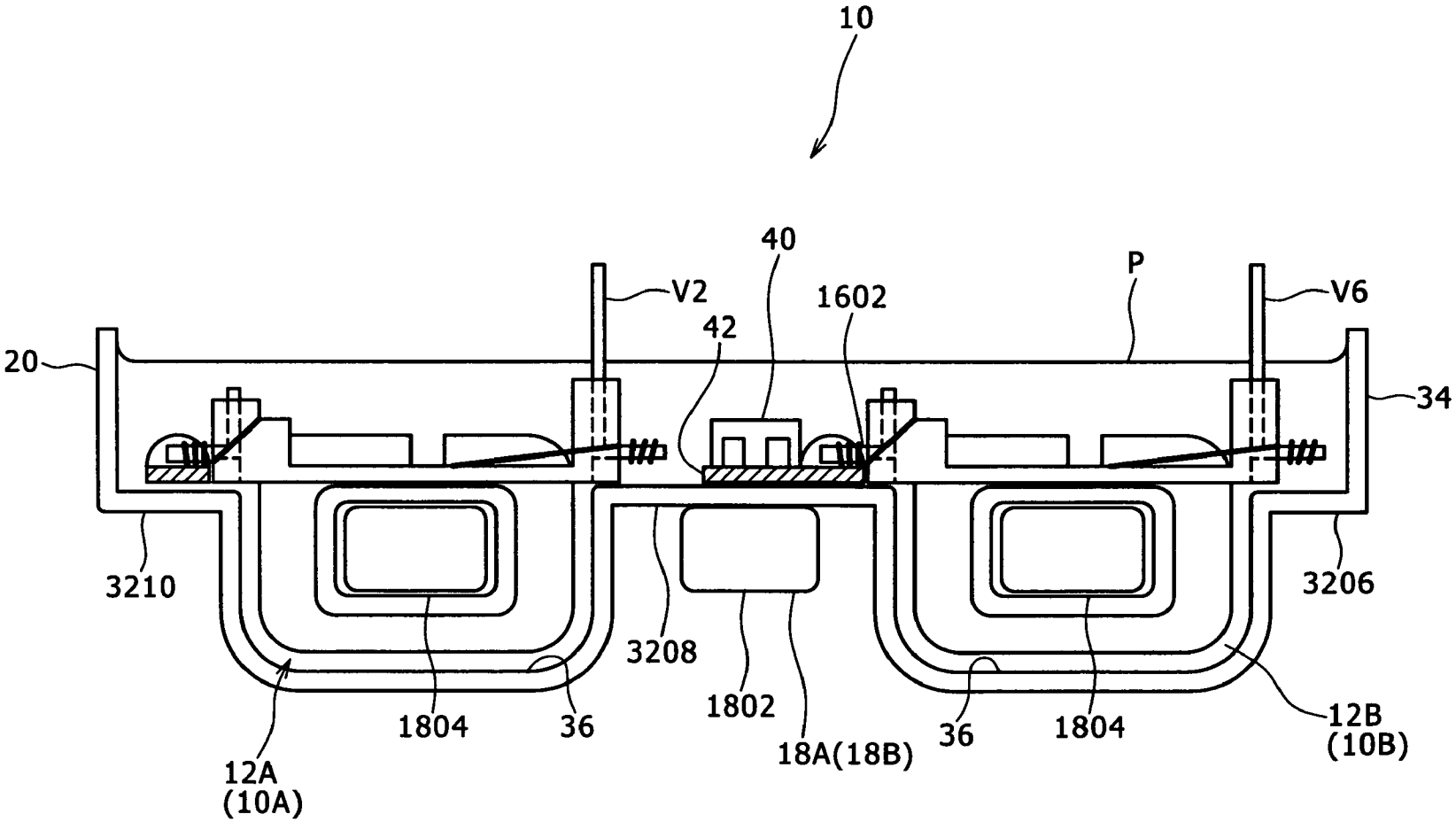
FIG. 14 is a sectional view showing a transformer according to a fourth embodiment of the present invention.

FIG. 14 shows a configuration of a transformer 10 according to the fourth embodiment of the present invention.

The fourth embodiment provides an example of a structure of the transformer 10 for implementing the backlight apparatus 100 according to the third embodiment.

Referring to FIG. 14, in the present embodiment, the photo-coupler 40 is mounted on a substrate 42 which is sealed in a case 20 together with two bobbins 12A and 12B by a sealing material P. A synthetic resin material having an insulating property can be used for the sealing material P, and, for example, an epoxy resin can be used as the synthetic resin material.

The substrate 42 has wiring line patterns formed thereon in such a manner as to connect the intermediate terminals 1602 of the transformers 10A and 10B and the input terminals 4002 and 4004 of the photo-coupler 40 to each other.

Further, the substrate 42 has wiring line patterns formed thereon which are connected to the output terminals 4006 and 4008 of the photo-coupler 40. The output terminals 4006 and 4008 are connected to the wiring line patterns and also to the first power supply 102 and the backlight controlling/driving circuit 106 provided on the outer side of the case 20 through wiring line members connected to the wiring line patterns.

According to the fourth embodiment, the transformer 10 can be configured by sealing the substrate 42 having the photo-couplers 40 mounted thereon within the case 20. This is advantageous in achievement of downsizing.

Further, the sealing of the photo-coupler 40 in this manner is advantages in achievement in improvement of the insulation property.

It is to be noted that, in place of such sealing of the photo-coupler 40, the input terminals 4002 and 4004 of the photo-coupler 40 and the intermediate terminals 1602 may be connected outside the case 20, and the output terminals 4006 and 4008 of the photo-coupler 40 and the first power supply 102 and backlight controlling/driving circuit 106 may be connected.

In this instance, however, from the necessity to assure the insulation of the intermediate terminals 1602 and the input terminals 4002 and 4004 and output terminals 4006 and 4008 of the photo-coupler 40, it cannot be avoided to assure a large space for layout of wiring lines, which is disadvantageous in achievement of downsizing. However, where the photo-coupler 40 is sealed in the case 20 of the transformer 10 using the sealing material P as in the present embodiment, since the necessity for such useless space for layout of wiring lines is eliminated, downsizing can be anticipated advantageously.

Fifth Embodiment

Now, a fifth embodiment of the present invention is described.

Figure 15A:
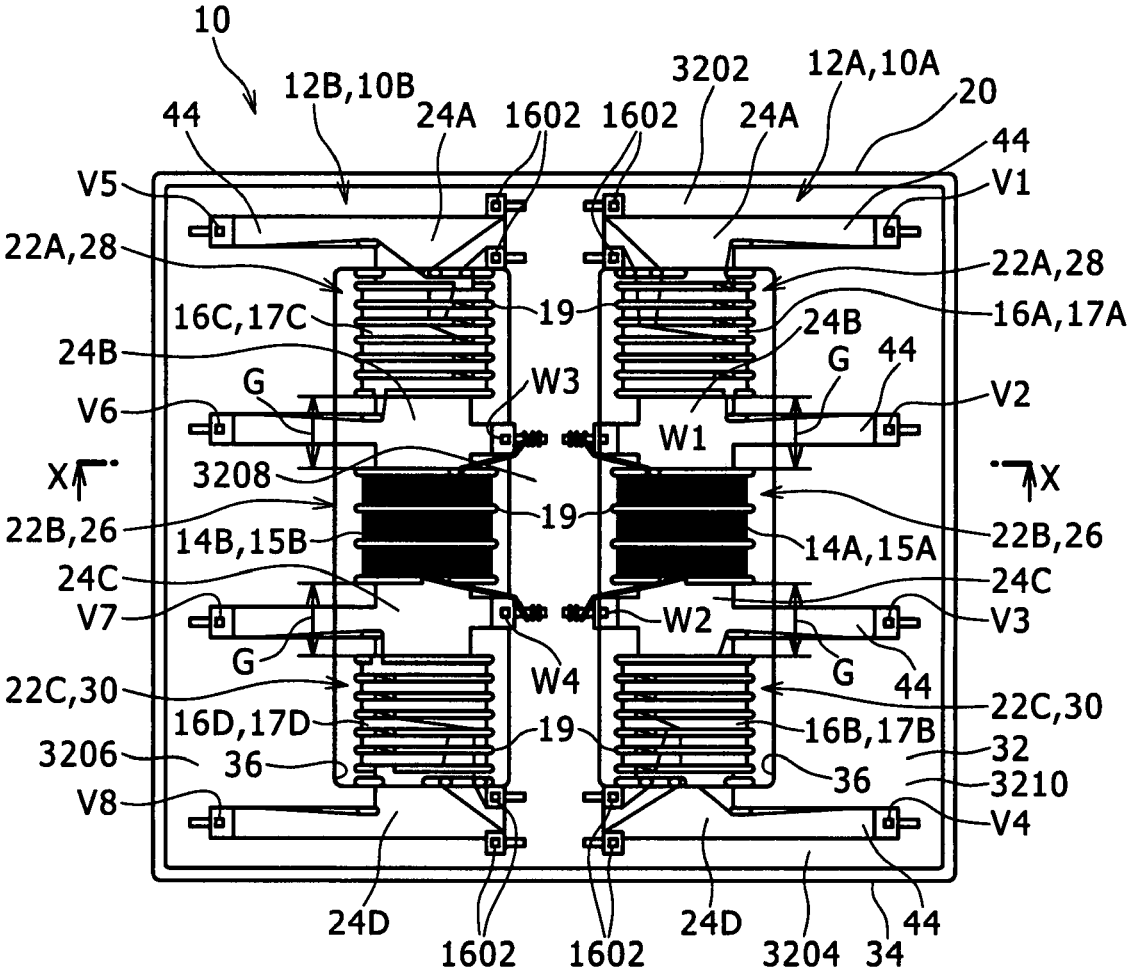
FIG. 15A is a top plan view showing a transformer according to a fifth embodiment of the present invention and FIG. 15B is a sectional view taken along line X-X of FIG. 15A.
Figure 15B:
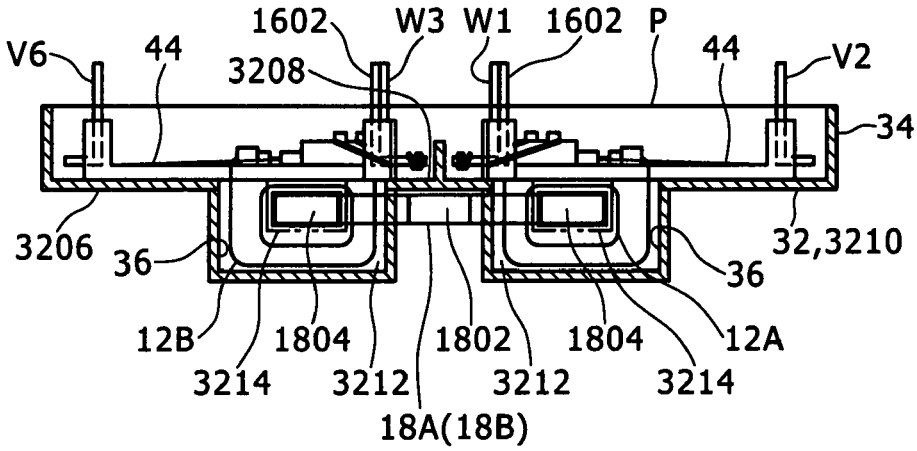

FIGS. 15A and 15B show a transformer according to the fifth embodiment of the present invention.

The fifth embodiment provides another example of a particular structure of the transformer 10 according to the third embodiment.

In the first embodiment of the present invention described above, the terminals w1 and w2 and the terminal v4 are spaced from each other by a great distance in the axial direction of the first to third cylindrical portions 22A, 22B and 22C, and the terminals w3 and w4 and the terminal v8 are spaced from each other by a great distance in the axis direction of the first to third cylindrical portions 22A, 22B and 22C. However, in the present fifth embodiment, the terminals w1 and w2 and the terminals v2 and v3 are spaced from each other by a great distance in a direction perpendicular to the axial direction of the first to third cylindrical portions 22A, 22B and 22C, and the terminals w3 and w4 and the terminals v6 and v7 are spaced from each other by a great distance in a direction perpendicular to the axial direction of the first to third cylindrical portions 22A, 22B and 22C.

Referring to FIG. 15A, the first bobbin 12A includes a first primary winding receiving portion 15A having a first primary winding 14A wound thereon in an axial direction, and first and second secondary winding receiving portions 17A and 17B having first and second secondary windings 16A and 16B wound thereon in an axial direction.

The second bobbin 12B includes a second primary winding receiving portion 15B having a second primary winding 14B wound thereon in an axial direction, and third and fourth secondary winding receiving portions 17C and 17D having third and fourth secondary windings 16C and 16D wound thereon in an axial direction.

The two bobbins 12A and 12B on which the windings mentioned are wound are accommodated in the case 20, and two cores 18A and 18B are inserted in an axial direction in the first and second primary winding receiving portions 15A and 15B and the first to fourth secondary winding receiving portions 17A, 17B, 17C and 17D.

The bobbins 12A and 12B are sealed in the case 20 by the sealing material P to construct the transformer 10.

More particularly, the bobbins 12A and 12B have a same shape and include three first to third cylindrical portions 22A, 22B and 22C having a rectangular cross section and four first to fourth plate portions 24A, 24B, 24C and 24D.

The first plate portion 24A is connected to the first cylindrical portion 22A.

The second plate portion 24B is connected to the first cylindrical portion 22A and the second cylindrical portion 22B.

The third plate portion 24C is connected to the second cylindrical portion 22B and the third cylindrical portion 22C.

The fourth plate portion 24D is connected to the third cylindrical portion 22C.

The first to third cylindrical portions 22A, 22B and 22C are connected to each other by the first to fourth plate portions 24A, 24B, 24C and 24D so as to extend along the same axis.

The first to fourth plate portions 24A, 24B, 24C and 24D are provided at locations at which they contact with the first to third cylindrical portions 22A, 22B and 22C.

A plurality of flanges 19 for defining the position of wiring lines and the width of the wiring lines in the axial direction are provided on the first to third cylindrical portions 22A, 22B and 22C in a spaced relationship from each other in the axial direction of the first to third cylindrical portions 22A, 22B and 22C.

The second cylindrical portion 22B serves as the primary winding receiving cylindrical portion 26, and the first and third cylindrical portions 22A and 22C serve as the secondary winding receiving cylindrical portions 28 and 30, respectively.

The bobbins 12A and 12B are disposed in the case 20 such that the axes thereof extend in parallel to each other.

In the fifth embodiment, the first to fourth plate portions 24A, 24B, 24C and 24D are formed in a length smaller than that of the first to third cylindrical portions 22A, 22B and 22C.

An arm 44 is provided in a projecting manner in a direction perpendicular to the axial direction at each of locations of the two bobbins 12A and 12B remote from portions of the first to fourth plate portions 24A, 24B, 24C and 24D which are opposed to each other.

In the first bobbin 12A, the first primary winding receiving portion 15A is formed from the first primary winding 14A wound on the primary winding receiving cylindrical portion 26, and the first secondary winding receiving portion 17A is formed from the first secondary winding 16A wound on the secondary winding receiving cylindrical portion 28 which is one of the two secondary winding receiving cylindrical portions 28 and 30. Further, the second secondary winding receiving portion 17B is formed from the second secondary winding 16B wound on the other secondary winding receiving cylindrical portion 30.

In the first bobbin 12A, terminals w1 and w2 are provided at a location of the second plate portion 24B opposing to the second bobbin 12B and a location of the third plate portion 24C opposing to the second bobbin 12B, respectively, and the opposite ends of the first primary winding 14A are connected to the terminals w1 and w2.

Further, in the first bobbin 12A, terminals v1 and v2 are provided at a free end of the substrate 42 of the first plate portion 24A and a free end of the substrate 42 of the second plate portion 24B, respectively, and the opposite ends of the first secondary winding 16A are connected to the terminals v1 and v2.

Further, in the first bobbin 12A, terminals v3 and v4 are provided at a free end of the substrate 42 of the third plate portion 24C and a free end of the substrate 42 of the fourth plate portion 24D, respectively, and the opposite ends of the second secondary winding 16B are connected to the terminals v3 and v4.

Further, in the first bobbin 12A, two intermediate terminals 1602 of the first secondary winding 16A are provided at locations of the first plate portion 24A opposing to the second bobbin 12B.

Furthermore, in the first bobbin 12A, two intermediate terminals 1602 of the second secondary winding 16B are provided at locations of the fourth plate portion 24D opposing to the second bobbin 12B.

In the second bobbin 12B, the first primary winding receiving portion 15B is formed from the second primary winding 14B wound on the primary winding receiving cylindrical portion 26, and the third secondary winding receiving portion 17C is formed from the third secondary winding 16C wound on the secondary winding receiving cylindrical portion 28 which is one of the two secondary winding receiving cylindrical portions 28 and 30. Further, the fourth secondary winding receiving portion 17D is formed from the fourth secondary winding 16D wound on the other secondary winding receiving cylindrical portion 30.

In the second bobbin 12B, terminals w3 and w4 are provided at a location of the second plate portion 24B opposing to the first bobbin 12A and a location of the third plate portion 24C opposing to the first bobbin 12A, and the opposite ends of the second primary winding 14B are connected to the terminals w3 and w4.

Further, in the second bobbin 12B, terminals v5 and v6 are provided at a free end of the substrate 42 of the first plate portion 24A and a free end of the substrate 42 of the second plate portion 24B, respectively, and the opposite ends of the third secondary winding 16C are connected to the terminals v5 and v6.

Further, in the second bobbin 12B, terminals v7 and v8 are provided at a free end of the substrate 42 of the third plate portion 24C and a free end of the substrate 42 of the fourth plate portion 24D, respectively, and the opposite ends of the fourth secondary winding 16D are connected to the terminals v7 and v8.

Further, in the second bobbin 12B, two intermediate terminals 1602 of the third secondary winding 16C are provided at locations of the first plate portion 24A opposing to the first bobbin 12A.

Furthermore, in the second bobbin 12B, two intermediate terminals 1602 of the fourth secondary winding 16D are provided at locations of the fourth plate portion 24D opposing to the first bobbin 12A.

Further, similarly as in the first embodiment, in the first bobbin 12A, a gap G is provided along the axis between the first primary winding receiving portion 15A and the first secondary winding receiving portion 17A. Further, another gap G is provided along the axis between the first primary winding receiving portion 15A and the second secondary winding receiving portion 17B. The gaps G are formed in a same size.

Meanwhile, in the second bobbin 12B, a gap G is provided along the axis between the second primary winding receiving portion 15B and third secondary winding receiving portion 17C. Further, another gap G is provided along the axis between the second primary winding receiving portion 15B and the fourth secondary winding receiving portion 17D. The gaps G are formed in a same size.

In the present embodiment, the gaps G of the first bobbin 12A and the gaps G of the second bobbin 12B are all formed in a same size.

As seen in FIGS. 15A and 15B, the case 20 includes a bottom plate 32 having a rectangular shape in plan, and side walls 34 erected uprightly from the four sides of the bottom plate 32.

A pair of concave portions 36 for bobbin accommodation are provided in a spaced relationship from each other in a direction perpendicular to the longitudinal direction at a central portion of the bottom plate 32.

As a result of the provision of the two concave portions 36, a first plate portion 3202 positioned at one end in the extending direction of the concave portions 36, a second plate portion 3204 positioned at the other end in the extending direction of the concave portions 36 and third to fifth plate portions 3206, 3208 and 3210 provided between the side walls 34 on the opposite sides and the two concave portions 36 are formed.

The first, second, third and fifth plate portions 3202, 3204, 3206 and 3210 are formed with a width sufficient to receive the arms 44 thereon.

As seen in FIG. 15B, an opening 3214 is formed in each of wall portions 3212 positioned at the opposite ends in the extending direction of the concave portions 36.

The cores 18A and 18B have an E shape and are formed from ferrite similarly as in the first embodiment.

Each of the cores 18A and 18B has a central magnetic leg portion 1802 disposed below the fourth plate portion 3208, and a pair of outer magnetic leg portions 1804 for being inserted into the first to third cylindrical portions 22A, 22B and 22C in the concave portions 36 through an openings 3214.

The central magnetic leg portion 1802 is formed in such a dimension that central magnetic leg portions 1802 of the cores 18A and 18B contact at free ends thereof with each other where they are inserted along the fourth plate portion 3208 between the concave portions 36 neighboring at the opposite ends in the longitudinal direction of the concave portions 36.

The outer magnetic leg portions 1804 are formed in such a dimension that the outer magnetic leg portions 1804 of the cores 18A and 18B contact at free ends thereof with each other where they are inserted in the concave portions 36 through the openings 3214 at the opposite ends in the longitudinal direction of the concave portions 36.

The first bobbin 12A has the primary winding receiving cylindrical portion 26 on which the first primary winding 14A is wound, the secondary winding receiving cylindrical portion 28 on which the first secondary winding 16A is wound, and the secondary winding receiving cylindrical portion 30 on which the second secondary winding 16B is wound. The primary winding receiving cylindrical portion 26, secondary winding receiving cylindrical portion 28 and secondary winding receiving cylindrical portion 30 of the first bobbin 12A are accommodated in one of the concave portions 36.

The second bobbin 12B has the primary winding receiving cylindrical portion 26 on which the second primary winding 14B is wound, the secondary winding receiving cylindrical portion 28 on which the third secondary winding 16C is wound, and the secondary winding receiving cylindrical portion 30 on which the fourth secondary winding 16D is wound. The primary winding receiving cylindrical portion 26, secondary winding receiving cylindrical portion 28 and secondary winding receiving cylindrical portion 30 of the second bobbin 12B are accommodated in the other of the concave portions 36.

In the first bobbin 12A, the terminal v1 is placed on the first plate portion 3202 together with an arm 44, and the terminals v2 and v3 are placed on the fifth plate portion 3210 together with corresponding arms 44 while the terminal v4 is placed on the second plate portion 3204 together with a corresponding arm 44.

Further, in the first bobbin 12A, the two intermediate terminals 1602 provided on the first plate portion 24A are placed on the first plate portion 3202, and the two intermediate terminals 1602 provided on the fourth plate portion 24D are placed on the second plate portion 3204.

Meanwhile, in the second bobbin 12B, the terminal v5 is placed on the first plate portion 3202 together with an arm 44, and the terminals v6 and v7 are placed on the third plate portion 3206 together with different arms 44 while the terminal v8 is placed on the second plate portion 3204 together with a further arm 44.

Further, in the second bobbin 12B, the two intermediate terminals 1602 provided on the first plate portion 24A are placed on the first plate portion 3202, and the two intermediate terminals 1602 provided on the fourth plate portion 24D are placed on the second plate portion 3204.

The cores 18A and 18B are fitted along the axial direction of the windings through the openings 3214 and under the lower face of the fourth plate portion 3208 from the opposite ends in the longitudinal direction of the concave portions 36. The central magnetic leg portion 1802 and the outer magnetic leg portions 1804 of the two cores 18A and 18B contact at free ends thereof with each other with a core spacer, a silicone thermo-setting adhesive layer or the like interposed therebetween thereby to form magnetic paths which pass the central magnetic leg portion 1802 and the outer magnetic leg portions 1804. After the assembly thus produced is left at a high temperature (for example, 105° C.) for hardening of the silicone adhesive and drying of the primary windings 14 and the secondary windings 16, sealing material P in a molten state is poured into the concave portions 36 and onto the bottom plate 32 to seal the bobbins 12A and 12B.

According to the fifth embodiment, similar effects to those achieved by the circuit configuration which uses the photocoupler 40 according to the third embodiment can be achieved.

Further, according to the fifth embodiment, not only a similar effect to that of the first embodiment is achieved, but also the following effect is achieved.

In particular, in the embodiment described hereinabove, the terminals w1 and w2 and the terminal v4 are spaced from each other by a great distance in the axial direction of the first to third cylindrical portions 22A, 22B and 22C and the terminals v3 and v4 and the terminal v8 are spaced from each other by a great distance in the axial direction of the first to third cylindrical portions 22A, 22B and 22C to assure the insulation between the primary side and the secondary side.

In contrast, in the fifth embodiment, the terminals w1 and w2 and the terminals v1 to v4 are spaced from each other by a great distance in a direction perpendicular to the axial direction of the first to third cylindrical portions 22A, 22B and 22C and the terminals w3 and w4 and the terminals v5 to v8 are spaced from each other by a great distance in a direction perpendicular to the axial direction of the first to third cylindrical portions 22A, 22B and 22C to assure the insulation between the primary side and the secondary side.

Accordingly, in the first embodiment, where the transformer 10 is turned upon winding of the winding wires and is acted upon by centrifugal force, since the dimension of the bobbins 12A and 12B in the axial direction (lengthwise direction) of the fourth plate portion 24D is great, there is a disadvantage that the second plate portion 3204 is liable to be deformed in the thicknesswise direction by the centrifugal force.

In contrast, in the fifth embodiment, the dimension of the first to fourth plate portions 24A, 24B, 24C and 24D of the bobbins 12A and 12B in the axial direction can be reduced from that in the first embodiment. Therefore, even if the transformer 10 is turned upon winding of the winding wires and is acted upon by centrifugal force, the first to fourth plate portions 24A, 24B, 24C and 24D are less liable to be deformed in the thickness direction by the centrifugal force. Consequently, the strength of the bobbins 12A and 12B can be assured advantageously.

Sixth Embodiment

Now, a sixth embodiment of the present invention is described.

Figure 16A:
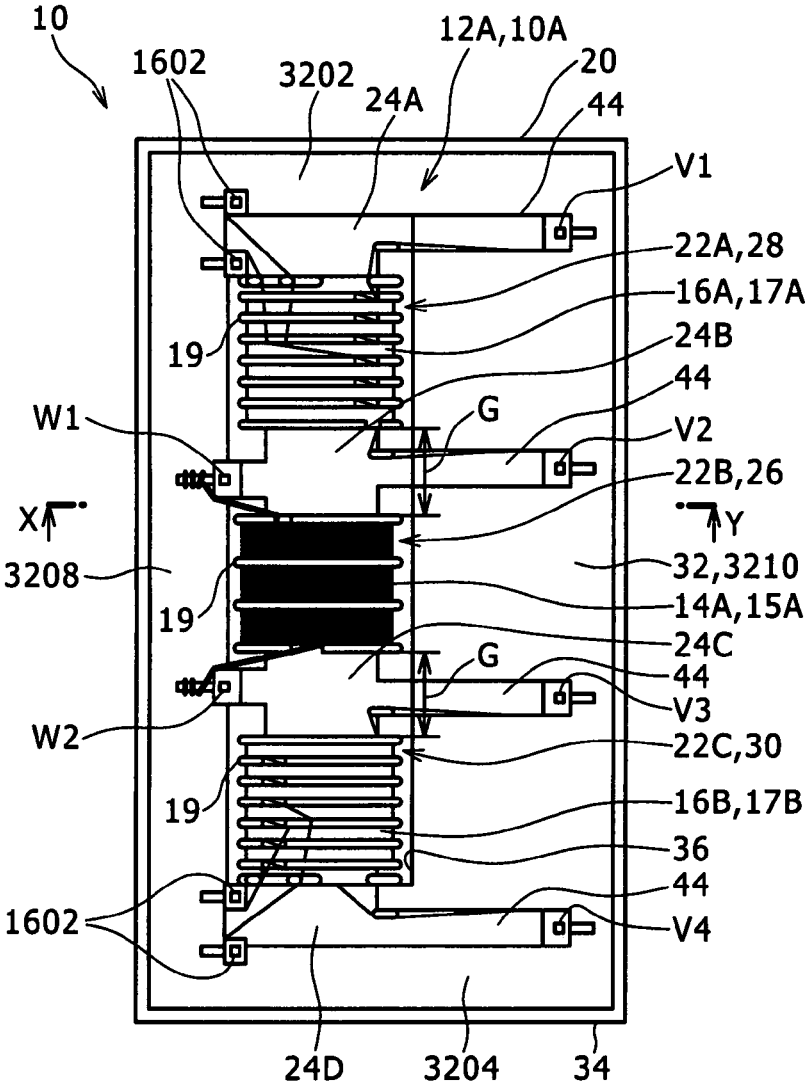
FIG. 16A is a top plan view showing a transformer according to a sixth embodiment of the present invention and FIG. 16B is a sectional view taken along line X-X of FIG. 16A.
Figure 16B:
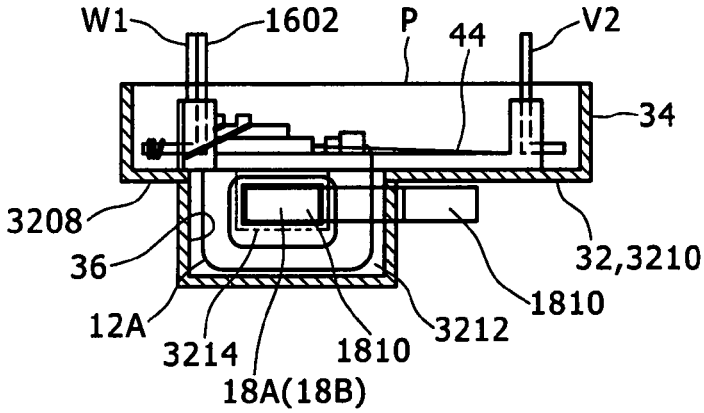

FIGS. 16A and 16B show a transformer 10 according to the sixth embodiment of the present invention.

The sixth embodiment is a modification to the fifth embodiment.

While, in the fifth embodiment, the bobbins 12A and 12B are used to form the transformer 10, in the present sixth embodiment, one bobbin 12 is used to form the transformer 10.

Referring to FIGS. 16A and 16B, in the sixth embodiment, only the first bobbin 12A in the fifth embodiment is used as the bobbin 12.

Corresponding to the first bobbin 12A used, only one concave portion 36 is provided on the case 20. Further, the case 20 in the sixth embodiment is formed in a size smaller than that of the case 20 in the fifth embodiment.

Further, corresponding to the single number of the bobbin 12 used, also the structure of the cores 18 is formed as a U-shaped structure which has two magnetic leg portions 1810 different from those in the fifth embodiment.

The first bobbin 12A is placed into the case 20, and sealing material P is poured to the first bobbin 12A from above to seal the first bobbin 12A. Then, the cores 18A and 18B are inserted along the axial direction of the wirings through the openings 3214 and under the lower face of the fourth plate portion 3208 from the opposite ends in the longitudinal direction of the concave portions 36.

Then, as the free ends of the magnetic leg portions 1810 of the two cores 18 contact with each other, a magnetic path passing through the two magnetic leg portions 1810 is formed thereby to form the transformer 10. This process of production is similar to that in the fifth embodiment.

While, in the fifth embodiment, the four secondary windings 16 can be used to drive the eight cathode fluorescent lamps L since the transformer 10 is formed using the two first and second bobbins 12A and 12B, the present sixth embodiment is different from the fifth embodiment in that, since the single bobbin 12 is used to form the transformer 10, the fourth cathode fluorescent lamps L can be driven using the two secondary windings 16. The sixth embodiment achieves also the other effects of the fifth embodiment.

Seventh Embodiment

Now, a seventh embodiment of the present invention is described.

Figure 17:
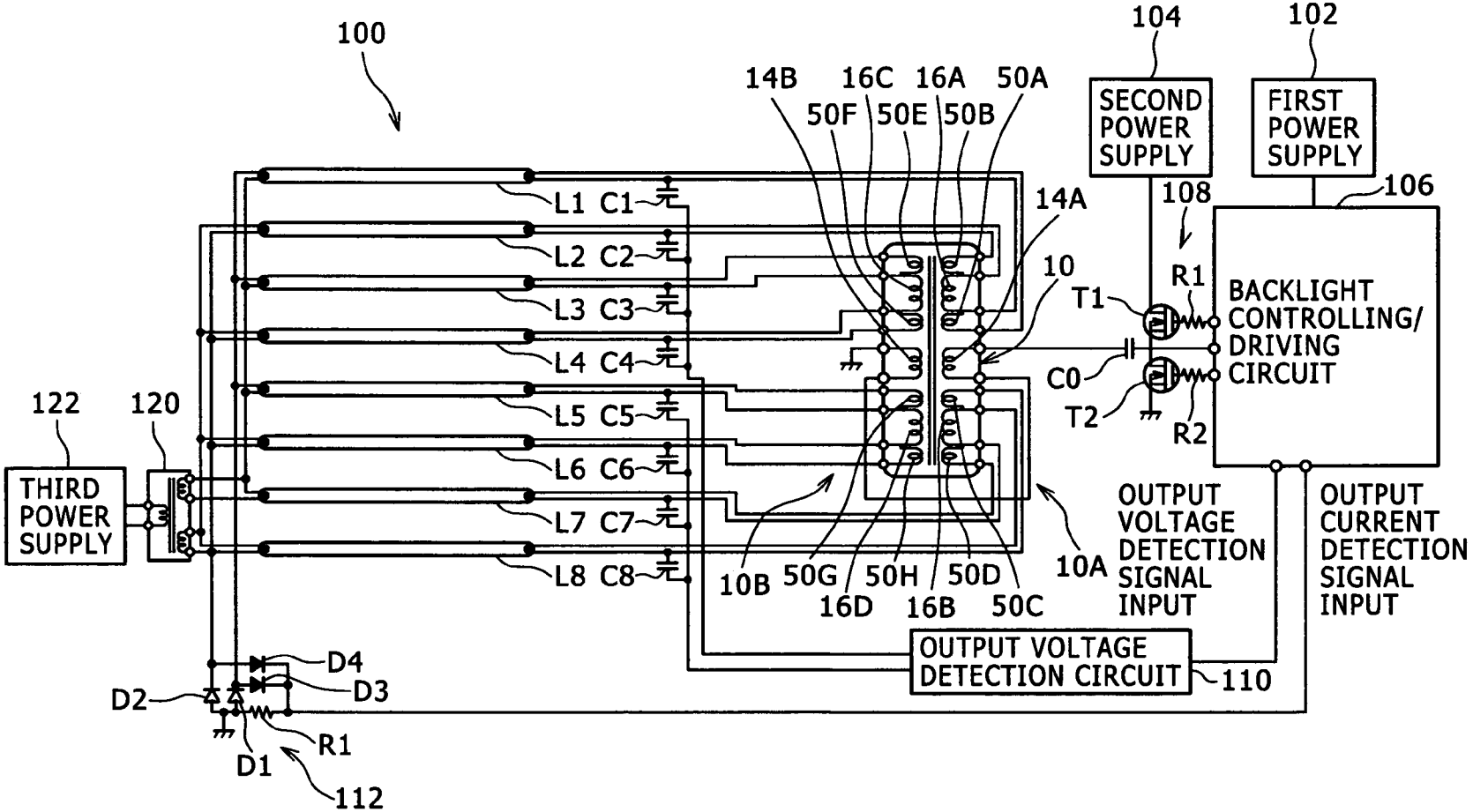
FIG. 17 is a circuit diagram showing a configuration of a backlight apparatus for which a transformer according to a seventh embodiment of the present invention is used.

FIG. 17 shows a configuration of a backlight apparatus 100 which uses the transformer 10 according to the seventh embodiment of the present invention.

The seventh embodiment uses a hot cathode fluorescent lamp (HCFL) for the cathode fluorescent lamps L.

Therefore, the seventh embodiment is different from the first embodiment in that it additionally has a configuration for heating an electrode (filament) of the hot cathode fluorescent lamps. Except this, the seventh embodiment is substantially same as the first embodiment.

Referring to FIG. 17, the backlight apparatus 100 shown includes cathode fluorescent lamps L, a transformer 10, a first power supply 102, a second power supply 104, a backlight controlling/driving circuit 106, a switching circuit 108, an output voltage detection circuit 110, an output current detection circuit 112, a heater transformer 120, and a third power supply 122. The components of the backlight apparatus 100 except the cathode fluorescent lamps L, heater transformer 120 and third power supply 122 are configured similarly to those in the first embodiment, and therefore, overlapping description of them is omitted herein to avoid redundancy.

The cathode fluorescent lamps L include cathode fluorescent lamps L1 to L8 and emit light with a second high frequency voltage supplied from the transformer 10.

Further, since the cathode fluorescent lamps L are formed from a hot cathode fluorescent lamp, it is necessary to apply the second high-frequency voltage to the two electrodes of the cathode fluorescent lamps L to heat the two electrodes.

In the present embodiment, the transformer 10 is used to heat one of the electrodes while the heater transformer 120 is used to heat the other electrode.

In the present embodiment, the transformer 10 includes two transformers including a first transformer 10A formed from a first primary winding 14A and first and second secondary windings 16A and 16B and a second transformer 10B including a second primary winding 14B and third and fourth secondary windings 16C and 16D similarly to that of the first embodiment. The first and second secondary windings 14A and 14B are directly connected to each other.

Further, gaps G formed between the first primary winding receiving portion 15A and the first and second secondary winding receiving portions 17A and 17B and gaps G formed between the second primary winding receiving portion 15B and the third and fourth secondary winding receiving portions 17C and 17D have dimensions and coupling coefficients K similar to those in the first embodiment.

One end of the first primary winding 14A of the first transformer 10A is used as an input terminal to which the first frequency voltage is inputted from the switching circuit 108 (capacitor C0), and the first primary winding 14A is connected at the other end thereof to one end of the second primary winding 14B while the second primary winding 14B is grounded at the other end thereof. In other words, the first primary winding 14A and the second primary winding 14B are connected in series.

The first secondary winding 16A of the first transformer 10A is connected at one end thereof to one of electrodes of the first cathode fluorescent lamp L1 and at the other end thereof to one of electrodes of the second cathode fluorescent lamp L2.

The second secondary winding 16B of the first transformer 10A is connected at one end thereof to one of electrodes of the seventh cathode fluorescent lamp L7 and at the other end thereof to one of electrodes of the eighth cathode fluorescent lamp L8.

The third secondary winding 16C of the second transformer 10B is connected at one end thereof to one of electrodes of the third cathode fluorescent lamp L3 and at the other end thereof to one of electrodes of the fourth cathode fluorescent lamp L4.

The fourth secondary winding 16D of the second transformer 10B is connected at one end thereof to one of electrodes of the fifth cathode fluorescent lamp L5 and at the other end thereof to one of electrodes of the sixth cathode fluorescent lamp L6.

In the first transformer 10A, first and second electrode heating winding portions 50A and 50B are formed at the opposite ends of the first secondary winding 16A, and third and fourth electrode heating winding portions 50C and 50D are formed at the opposite ends of the second secondary winding 16B.

The first electrode heating winding portion 50A is connected at the opposite ends thereof to two electrodes (filaments) of the second cathode fluorescent lamp L2.

The second electrode heating winding portion 50B is connected at the opposite ends thereof to two electrodes (filaments) of the first cathode fluorescent lamp L1.

The third electrode heating winding portion 50C is connected at the opposite ends thereof to two electrodes (filaments) of the eighth cathode fluorescent lamp L8.

The fourth electrode heating winding portion 50D is connected at the opposite ends thereof to two electrodes (filaments) of the seventh cathode fluorescent lamp L7.

In the second transformer 10B, fifth and sixth electrode heating winding portions 50E and 50F are formed at the opposite ends of the third secondary winding 16C, and seventh and eighth electrode heating winding portions 50G and 50H are formed at the opposite ends of the fourth secondary winding 16D.

The fifth electrode heating winding portion 50E is connected at the opposite ends thereof to two electrodes (filaments) of the third cathode fluorescent lamp L3.

The sixth electrode heating winding portion 50F is connected at the opposite ends thereof to two electrodes (filaments) of the third cathode fluorescent lamp L4.

The seventh electrode heating winding portion 50G is connected at the opposite ends thereof to two electrodes (filaments) of the fifth cathode fluorescent lamp L5.

The eighth electrode heating winding portion 50H is connected at the opposite ends thereof to two electrodes (filaments) of the sixth cathode fluorescent lamp L6.

The heater transformer 120 transforms a voltage supplied from the third power supply 122 and supplies the transformed voltage to the other electrode (filament) of the cathode fluorescent lamps L1 to L8 to heat the electrodes.

Accordingly, the first high frequency voltage supplied from the switching circuit 108 to the transformer 10 is transformed into a higher second frequency voltage by the transformer 10 and supplied to the cathode fluorescent lamps L1 to L8. Consequently, current is supplied to the cathode fluorescent lamps L1 to L8.

Simultaneously, heating current is supplied to one electrode of the cathode fluorescent lamps L1 to L8 through the electrode heating winding portions 50A to 50H of the transformer 10 while heating current is supplied to the other electrode of the cathode fluorescent lamps L1 to L8 from the heater transformer 120.

Consequently, the cathode fluorescent lamps L1 to L8 emit light.

According to the seventh embodiment having the configuration described above, the cathode fluorescent lamps L1 to L8 formed from a hot cathode fluorescent lamp can be driven to emit light, and effects similar to those of the first embodiment can be achieved.

It should be understood by those skilled in the art that various modifications, combinations, sub-combinations and alterations may occur depending on design requirements and other factors insofar as they are within the scope of the appended claims or the equivalents thereof.

What is claimed is:

1. A transformer, comprising:

a primary winding receiving portion having a primary winding wound around an axis; and a pair of secondary winding receiving portions each having a secondary winding wound around an axis and disposed on the opposite sides of said first primary winding receiving portion with a gap left in the axial direction;

the gaps being formed in a size of a value higher than a first predetermined value, and the coupling coefficients between said first primary winding and said two secondary windings being set lower than a second predetermined value by the gaps.

2. The transformer according to claim 1, wherein the first predetermined value is higher than 5 mm but lower than 10 mm.

3. The transformer according to claim 1, wherein the first predetermined value is higher than 7 mm but lower than 10 mm.

4. The transformer according to claim 1, wherein the second predetermined value is higher than 0.5 but lower than 0.88.

5. The transformer according to claim 1, wherein the second predetermined value is higher than 0.5 but lower than 0.87.

6. The transformer according to claim 1, wherein two intermediate terminals are provided at portions of said secondary windings corresponding to a neutral point, and said transformer further comprises a photo-coupler having a pair of input terminals connected to said two intermediate terminals and an output terminal.

7. The transformer according to claim 1, wherein said transformer outputs, when a high frequency voltage is supplied to said primary winding, a second high frequency voltage higher than the first high frequency voltage from said secondary windings and supplies the second high frequency signal to a plurality of cathode fluorescent lamps so that the cathode fluorescent lamps are able to emit light, one of said secondary windings supplying the second high frequency voltage to one or two ones of said cathode fluorescent lamps so that the one or two cathode fluorescent lamps are able to emit light.

8. The transformer according to claim 1, further comprising a bobbin, a case, a sealing material and an core;

said primary wiring receiving portion and said secondary wiring receiving portions being provided on said bobbin with the gaps interposed, said case including a bottom plate, a concave portion provided on said bottom plate and accommodating said primary winding receiving portion and said secondary wiring receiving portions, and a pair of openings provided in opposing walls of said recessed portion, said sealing material being poured to said bottom plate while said primary winding receiving portion and said secondary winding receiving portions on said bobbin are accommodated in said recessed portion and placed on said bottom plate so that said bobbin including said primary winding receiving portion and said secondary winding receiving portions is sealed, and said core being disposed on the axis of said primary winding receiving portion and said secondary winding receiving portions through the openings of said recessed portion.

9. The transformer according to claim 8, wherein two such bobbins each having said primary winding receiving portion and said secondary winding receiving portions provided are provided on said case such that the axial directions of the wirings extend in parallel to each other.

10. A backlight apparatus, comprising:

a high frequency voltage generation section configured to generate a first high frequency voltage;

a transformer configured to generate, from the first high frequency voltage supplied from said high frequency voltage generation section, a second high frequency voltage higher than the first high frequency voltage; and a plurality of cathode fluorescent lamps configured to receive the second high frequency voltage supplied to emit light;

said transformer including a primary winding receiving portion having a primary winding wound around an axis, and a pair of secondary winding receiving portions each having a secondary winding wound around an axis and disposed on the opposite sides of said first primary winding receiving portion with a gap left in the axial direction, the gaps being formed in a size of a value higher than a first predetermined value, the coupling coefficients between said first primary winding and said two secondary windings being set lower than a second predetermined value by the gaps, the first high frequency voltage being supplied to said primary winding, and said secondary windings supplying the second high frequency voltage to said cathode fluorescent lamps.

11. A display apparatus, comprising:

a liquid crystal panel configured to display an image; and a backlight apparatus configured to illuminate said liquid crystal display panel;

said backlight apparatus including a high frequency voltage generation section configured to generate a first high frequency voltage, a transformer configured to generate, from the first high frequency voltage supplied from said high frequency voltage generation section, a second high frequency voltage higher than the first high frequency voltage, and a plurality of cathode fluorescent lamps configured to receive the second high frequency voltage supplied to emit light, said transformer including a primary winding receiving portion having a primary winding wound around an axis, and a pair of secondary winding receiving portions each having a secondary winding wound around an axis and disposed on the opposite sides of said first primary winding receiving portion with a gap left in the axial direction, the gaps being formed in a size of a value higher than a first predetermined value, the coupling coefficients between said first primary winding and said two secondary windings being set lower than a second predetermined value by the gaps, the first high frequency voltage being supplied to said primary winding, and said secondary windings supplying the second high frequency voltage to said cathode fluorescent lamps.

* * * * *